US009507288B2

(12) United States Patent
Yamashita et al.

(10) Patent No.: US 9,507,288 B2
(45) Date of Patent: Nov. 29, 2016

(54) IMAGE FORMING APPARATUS THAT DETECTS ELECTROSTATIC LATENT IMAGE FOR CORRECTION

(71) Applicant: CANON KABUSHIKI KAISHA, Tokyo (JP)

(72) Inventors: Kentaro Yamashita, Suntou-gun (JP); Yasuo Yoda, Numazu (JP); Akinobu Hirayama, Suntou-gun (JP); Takateru Ohkubo, Susono (JP); Kenji Watanabe, Suntou-gun (JP); Hiromitsu Kumada, Susono (JP); Yoshiko Kubo, Osaka (JP); Hiroshi Hagiwara, Suntou-gun (JP); Shuhei Watanabe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/366,375

(22) PCT Filed: Dec. 27, 2012

(86) PCT No.: PCT/JP2012/084292

§ 371 (c)(1),
(2) Date: Jun. 18, 2014

(87) PCT Pub. No.: WO2013/114789

PCT Pub. Date: Aug. 8, 2013

(65) Prior Publication Data

US 2014/0314433 A1 Oct. 23, 2014

(30) Foreign Application Priority Data

Jan. 31, 2012 (JP) ..... 2012-018641

(51) Int. Cl.

| | |
|---|---|
| ***G03G 15/01*** | (2006.01) |
| ***G03G 15/043*** | (2006.01) |
| ***G03G 15/00*** | (2006.01) |

(52) U.S. Cl.

CPC ..... *G03G 15/043* (2013.01); *G03G 15/0189* (2013.01); *G03G 15/5037* (2013.01); *G03G 2215/0132* (2013.01); *G03G 2215/0158* (2013.01)

(58) Field of Classification Search

CPC ..... G03G 2215/0161; G03G 2215/0132; G03G 2215/0155; G03G 15/0189; G03G 15/5037; G03G 15/043

USPC ..... 399/301, 56

See application file for complete search history.

(56) References Cited

U.S. PATENT DOCUMENTS

| | | | | |
|---|---|---|---|---|
| 8,600,274 | B2 | 12/2013 | Uchiyama et al. | |
| 2010/0209124 | A1* | 8/2010 | Mizutani | G03G 15/5033 399/16 |
| 2012/0008995 | A1 | 1/2012 | Shigemura et al. | |

FOREIGN PATENT DOCUMENTS

| | | | |
|---|---|---|---|
| EP | 2 402 825 | A2 | 1/2012 |
| EP | 2 402 825 | A3 | 1/2012 |
| JP | 06-130767 | A | 5/1994 |
| JP | 7-234612 | A | 9/1995 |

(Continued)

OTHER PUBLICATIONS

Office Action dated Aug. 17, 2015, in Japanese Patent Application No. 2012-018641.

(Continued)

*Primary Examiner* — Billy Lactaoen

(74) *Attorney, Agent, or Firm* — Fitzpatrick, Cella, Harper & Scinto

(57) ABSTRACT

An image forming apparatus includes: a photosensitive member configured to be rotated; scanning means for scanning, by light corresponding to image data, the photosensitive member that is charged, thereby forming an electrostatic latent image on the photosensitive member; and a contacting member in contact with the photosensitive member to form a nip portion. In a correction mode in which a shift of an image is corrected based on a detection result obtained by detecting, at the nip portion, an electrostatic latent image for correction formed on the photosensitive member by the scanning means, a width of the electrostatic latent image for correction is equal to or more than a width of the nip portion in a rotation direction of the photosensitive member.

16 Claims, 19 Drawing Sheets

(56) References Cited

FOREIGN PATENT DOCUMENTS

| | | | |
|---|---|---|---|
| JP | 7-253692 | A | 10/1995 |
| JP | 10-039571 | A | 2/1998 |
| JP | 2002-214853 | A | 7/2002 |
| JP | 4432377 | B2 | 3/2010 |
| JP | 2011-203320 | A | 10/2011 |
| JP | 2012-014176 | A | 1/2012 |
| KR | 2012-0002486 | A | 1/2012 |

OTHER PUBLICATIONS

R. M. Schaffert, "Electrophotography", Kyoritsu Shuppan, pp. 288-299, 1973.
Office Action issued in Korean Patent Application No. 10-2014-7023498, dated Dec. 28, 2015.
Search Report issued in European Patent Application No. 12867668.1, dated Dec. 21, 2015.

* cited by examiner

IMAGE FORMING APPARATUS THAT DETECTS ELECTROSTATIC LATENT IMAGE FOR CORRECTION

TECHNICAL FIELD

The present invention relates to a color misregistration detection technique in an image forming apparatus.

BACKGROUND ART

An image forming apparatus called a tandem type is known, which forms toner images on photosensitive members corresponding to the respective colors and transfers the toner images to the intermediate transfer belt in a superimposed manner, thereby generating a color image. In such an image forming apparatus, so-called color misregistration occurs when the relative positions of the toner images shift when they are superimposed.

To cope with this, Japanese Patent Laid-Open No. 7-234612 discloses forming the toner images of the respective colors for color misregistration detection on the intermediate transfer belt and detecting the relative positional shift between the toner images of the respective colors by an optical sensor, thereby performing correction.

However, since it is necessary to form the toner images for color misregistration detection on the intermediate transfer belt and further clean the formed toner images, the usability of the image forming apparatus lowers.

SUMMARY OF INVENTION

The present invention provides an image forming apparatus capable of shortening the time required for color misregistration control and accurately detecting color misregistration.

According to an aspect of the present invention, an image forming apparatus includes: a photosensitive member configured to be rotated; scanning means for scanning, by light corresponding to image data, the photosensitive member that is charged, thereby forming an electrostatic latent image on the photosensitive member; and a contacting member in contact with the photosensitive member to form a nip portion. In a correction mode in which a shift of an image is corrected based on a detection result obtained by detecting, at the nip portion, an electrostatic latent image for correction formed on the photosensitive member by the scanning means, a width of the electrostatic latent image for correction is equal to or more than a width of the nip portion in a rotation direction of the photosensitive member.

Further features of the present invention will become apparent from the following description of exemplary embodiments with reference to the attached drawings.

DESCRIPTION OF EMBODIMENTS

First Embodiment

Figure 1:
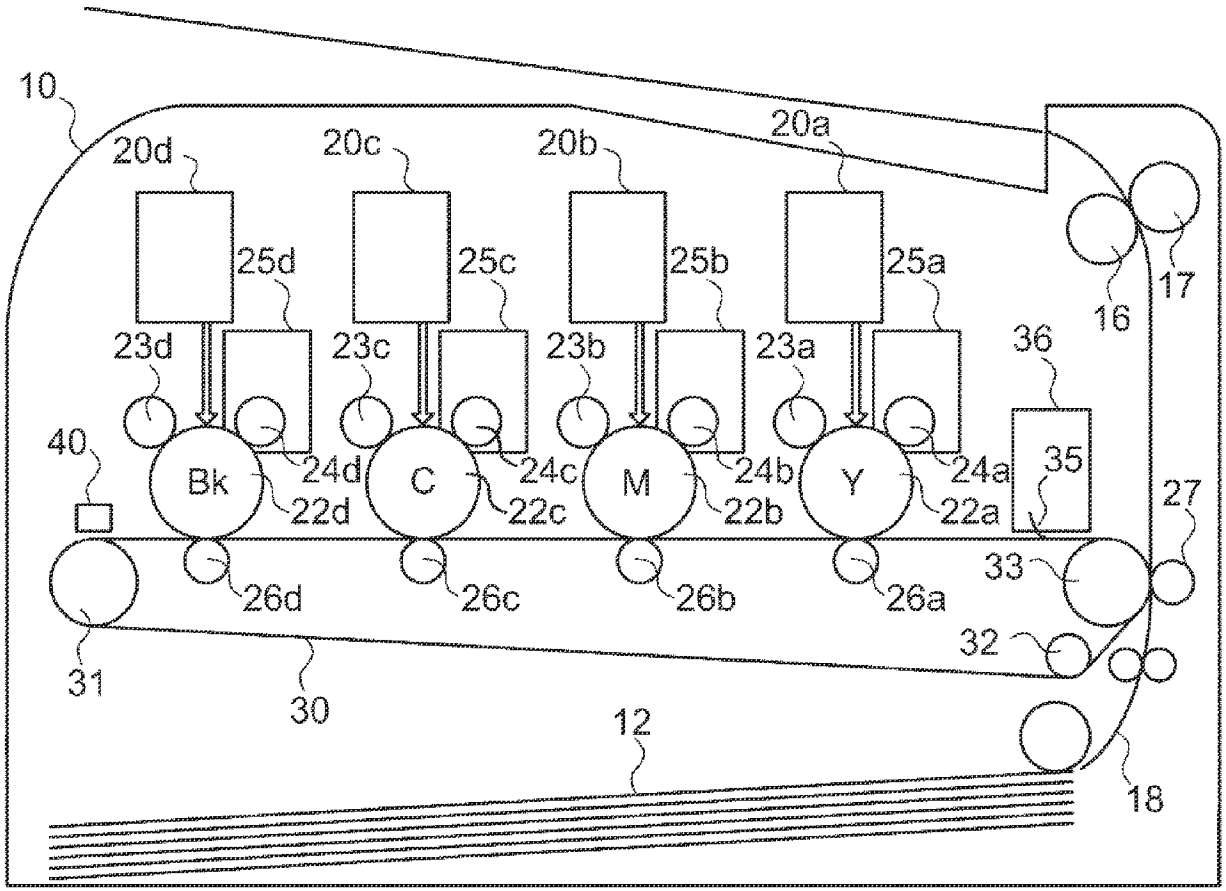
FIG. 1 is a view showing the arrangement of an image forming unit of an image forming apparatus according to an embodiment.

FIG. 1 is a view showing the arrangement of an image forming unit 10 of an image forming apparatus according to this embodiment. Note that the lower-case letters a, b, c, and d added to reference numerals as suffixes indicate that the members of interest correspond to yellow (Y), magenta (M), cyan (C), and black (Bk). Reference numerals without the suffixes a, b, c, and d in the lower-case letters are used when the colors need not be discriminated. A photosensitive member 22 is an image carrier and is rotatably driven about the rotating shaft. A charging roller 23 charges the surface of the photosensitive member 22 of the corresponding color to a uniform potential. For example, the charging bias output from the charging roller 23 is −1200 V, and the surface of the photosensitive member 22 is charged by this to a potential (dark potential) of −700 V. A scanner unit 20 scans the surface of the photosensitive member 22 by a laser beam corresponding to the image data of an image to be formed, thereby forming an electrostatic latent image on the photosensitive member 22. For example, the potential (bright potential) of the portion where the electrostatic latent image is formed by scanning of the laser beam is −100 V. A developing device 25 includes a toner of a corresponding color and supplies the toner to the electrostatic latent image on the photosensitive member 22 by a developing sleeve 24, thereby developing the electrostatic latent image on the photosensitive member 22. For example, the developing bias output from the developing sleeve 24 is −350 V, and the developing device 25 applies the toner to the electrostatic latent image by this potential. A primary transfer roller 26 transfers the toner image formed on the photosensitive member 22 to an intermediate transfer belt 30 that is an image carrier and is orbitally driven by rollers 31, 32, and 33. For example, the transfer bias output from the primary transfer roller 26 is +1000 V, and the primary transfer roller 26 transfers the toner to the intermediate transfer belt 30 by this potential. Note that the toner images on the photosensitive members 22 are transferred to the intermediate transfer belt 30 in a superimposed manner, thereby forming a color image.

A secondary transfer roller 27 transfers the toner image on the intermediate transfer belt 30 to a printing medium 12 conveyed through a conveyance path 18. A pair of fixing rollers 16 and 17 heat and fix the toner image transferred to the printing medium 12. A cleaning blade 35 collects, in a waste toner container 36, the toner that was not transferred by the secondary transfer roller 27 from the intermediate transfer belt 30 to the printing medium 12. In addition, a detection sensor 40 is provided while facing the intermediate transfer belt 30 to correct color misregistration by forming a conventional toner image.

Note that the scanner unit 20 may have a form to scan the photosensitive member 22 not by a laser but by an LED array or the like. Instead of providing the intermediate transfer belt 30, the image forming apparatus may transfer the toner images on the photosensitive members 22 directly to the printing medium 12.

Figure 2:
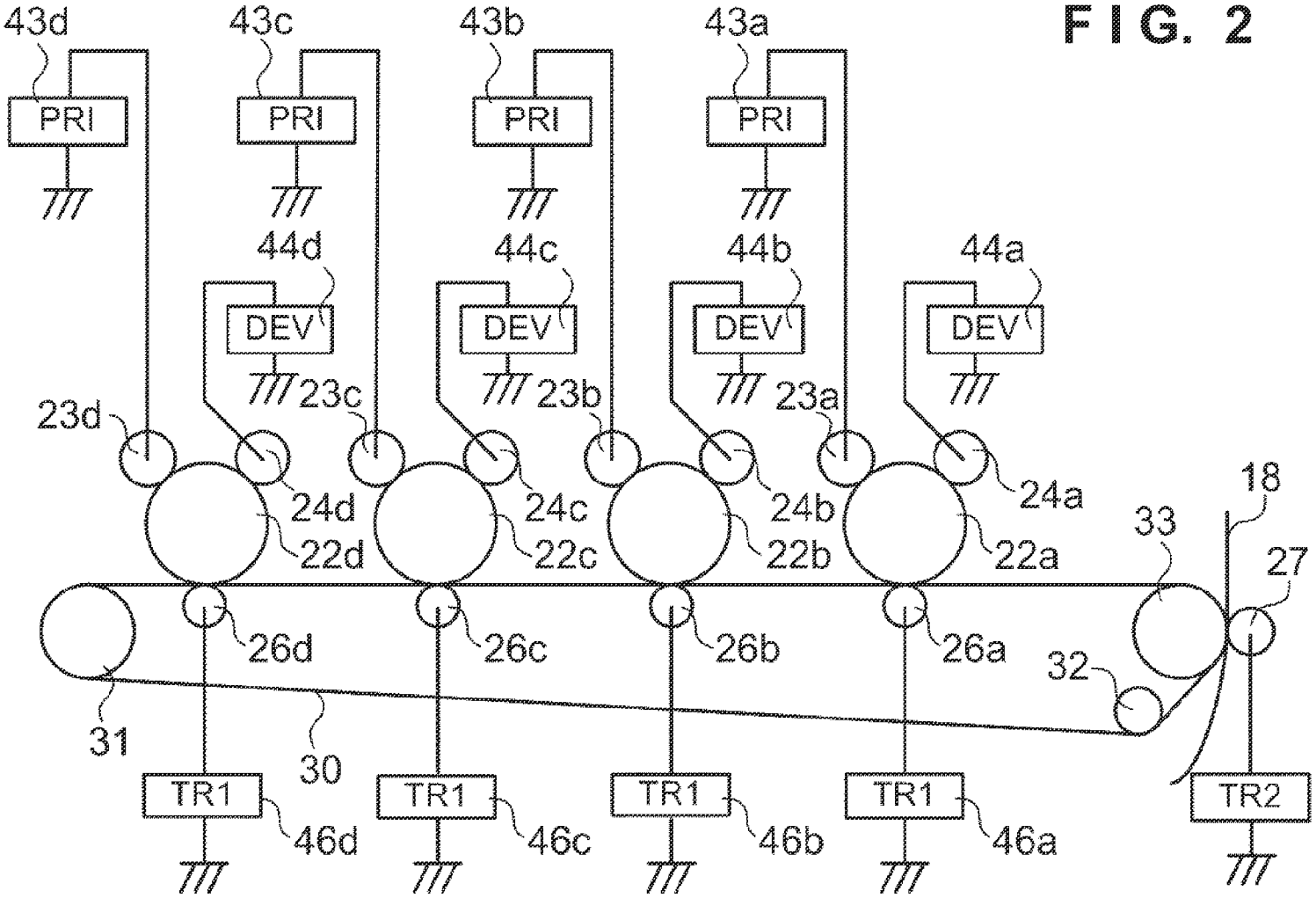
FIG. 2 is a view showing a system for supplying a high-voltage power to the image forming unit according to an embodiment.

FIG. 2 is a view showing a system for applying high voltage powers to the respective process units of the image forming unit 10. A process unit is a portion including the charging roller 23, the developing device 25, and the primary transfer roller 26, and acts on the photosensitive member 22 for image formation. A charging high-voltage power supply circuit 43 applies a voltage to the corresponding charging roller 23. A developing high-voltage power supply circuit 44 applies a voltage to the developing sleeve 24 of the corresponding developing device 25. A primary transfer high-voltage power supply circuit 46 applies a voltage to the corresponding primary transfer roller 26. The charging high-voltage power supply circuit 43, the developing high-voltage power supply circuit 44, and the primary transfer high-voltage power supply circuit 46 function as voltage application units for the process units.

Figure 3:
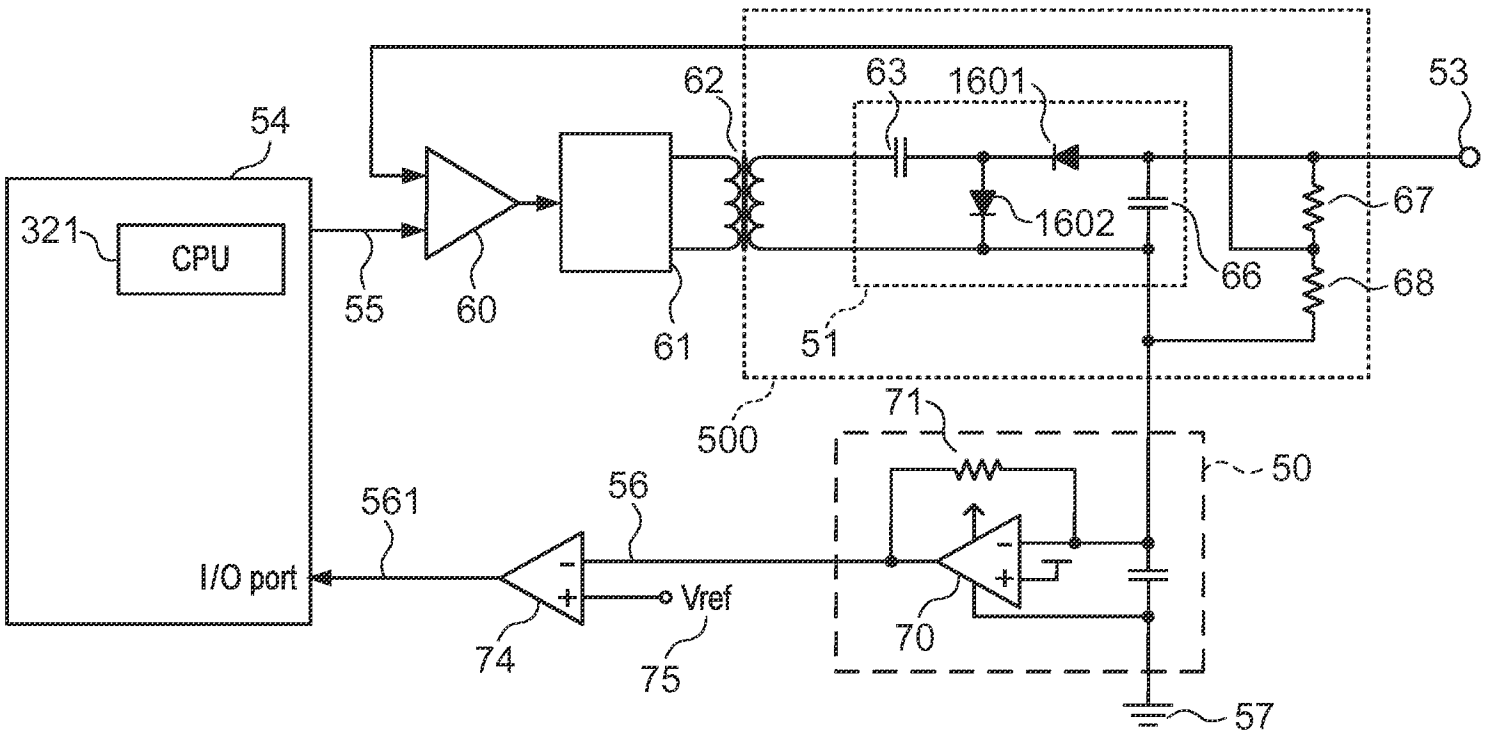
FIG. 3 is a circuit diagram showing a charging high-voltage power supply circuit according to an embodiment.

FIG. 3 is a circuit diagram showing the arrangement of the charging high-voltage power supply circuit 43 that applies a voltage to the charging roller 23. A transformer 62 boosts an AC signal from a driving circuit 61. A rectifying circuit 51 formed from diodes 1601 and 1602 and capacitors 63 and 66 rectifies and smoothes the boosted AC signal, and applies a DC voltage from an output terminal 53 to the charging roller 23. A comparator 60 controls the output voltage of the driving circuit 61 such that the voltage of the output terminal 53 divided by detection resistors 67 and 68 equals a voltage set value 55 set by a control unit 54. Note that a current having a magnitude corresponding to the voltage of the output terminal 53 flows via the charging roller 23, the photosensitive member 22, and ground.

In this embodiment, a current detection circuit 50 is inserted between a ground point 57 and an output circuit 500 on the secondary side of the transformer 62 in the charging high-voltage power supply circuit 43. The current flowing from the output terminal 53 to the current detection circuit 50 via the output circuit 500 of the transformer 62 flows from an operational amplifier 70 to ground via a resistor 71. A detected voltage 56 proportional to the current flowing to the resistor 71, that is, the amount of the current flowing to the output terminal 53 appears in the output terminal of the operational amplifier 70. The detected voltage 56 is input to the negative input terminal (inverting input terminal) of a comparator 74. The comparator 74 outputs a binarized voltage value 561 corresponding to the magnitude relationship between the detected voltage 56 and a reference voltage (Vref) 75 serving as a threshold.

The binarized voltage value 561 output from the comparator 74 is input to a CPU 321 in the control unit 54. The control unit 54 controls the entire image forming apparatus by, for example, controlling the scanner unit 20 to form an electrostatic latent image on each photosensitive member 22.

Color misregistration correction control according to this embodiment will be described next. Note that in this embodiment, color misregistration, that is, the positional shift between the respective colors is detected for each color. In this embodiment, an electrostatic latent image for positional shift correction (to be referred to as a latent image mark hereinafter) is formed on the photosensitive member 22 by scanning of the scanner unit 20, and the time at which the latent image mark reaches the position of the charging roller 23 is measured. A change in the measured reach time reflects the shift amount of the irradiation position of the scanner unit 20, that is, the positional shift amount of the image. The irradiation position of the scanner unit 20 is known to shift due to a change in the temperature inside the apparatus caused by continuous printing or the like. In this embodiment, a positional shift caused by a change in the temperature inside the apparatus can be detected in real time.

Figure 4:
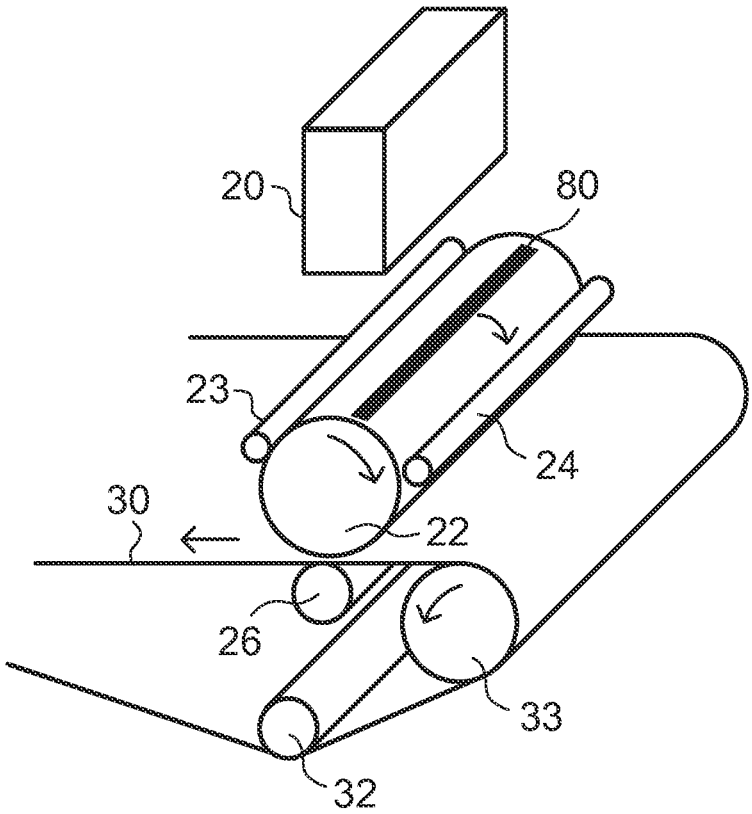
FIG. 4 is a view showing a latent image mark to be formed on an intermediate transfer belt.

A latent image mark detection method will be described first. FIG. 4 is a view showing a state in which a latent image mark 80 is formed on the photosensitive member 22. The latent image mark 80 formed on the photosensitive member 22 by the scanner unit 20 is conveyed in the direction of the arrow as the photosensitive member 22 rotates. Note that the developing sleeve 24 and the primary transfer roller 26 are separated from the photosensitive member 22 at this time. Alternatively, the applied voltage may be turned off (zero), or a bias voltage having a polarity opposite to the usual may be applied.

Figure 5A:
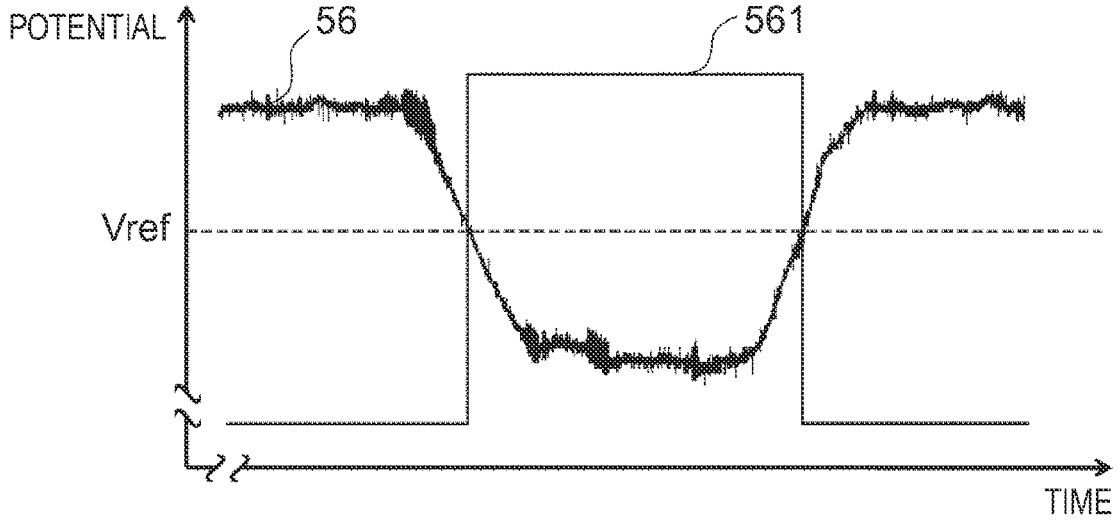
FIGS. 5A and 5B are explanatory views of latent image mark detection.

When the latent image mark 80 has reached the region near the charging roller 23, the amount of the current flowing from the photosensitive member 22 to the charging high-voltage power supply circuit 43 via the charging roller 23 changes. FIG. 5A shows the time-rate change in the detected voltage 56 of the current detection circuit 50 when the latent image mark 80 passes through the position of the charging roller 23. The detected voltage 56 shown in FIG. 5A starts decreasing when the latent image mark 80 has reached the region near the charging roller 23, and increases when the latent image mark 80 has started passing through the position of the charging roller 23. When the binarized voltage value 561 generated by causing the comparator 74 to binarize the detected voltage 56 is detected, the timing at which the leading edge of the latent image mark 80 has reached the charging roller 23 and the timing at which the trailing edge of the latent image mark 80 has passed through the charging roller 23 can be detected. Note that the leading edge of the latent image mark 80 means the edge of the latent image mark 80 on the downstream side in the rotation direction of the photosensitive member 22 (front side in the traveling direction), and the trailing edge means the edge on the upstream side (rear side in the traveling direction).

Figure 5B:
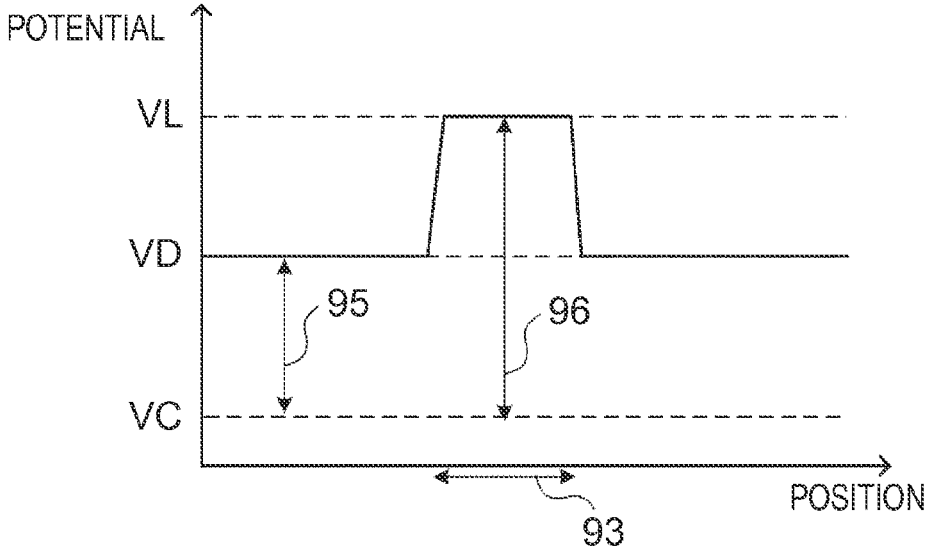

The reason why the detected voltage 56 lowers during the time the latent image mark 80 is located near the charging roller 23 will be described. FIG. 5B is a graph showing the surface potential of the photosensitive member 22. Note that the abscissa of FIG. 5B represents the surface position in the rotation direction of the photosensitive member 22, and a region 93 indicates the region where the latent image mark 80 is formed. Assume that no toner is applied to the latent image mark 80. The ordinate of FIG. 5B represents the potential. Let VD be the dark potential (for example, −600 V) of the photosensitive member 22, VL be the bright potential (for example, −150 V), and VC be the charging bias (for example, −1160 V) of the charging roller 23.

Figure 6:
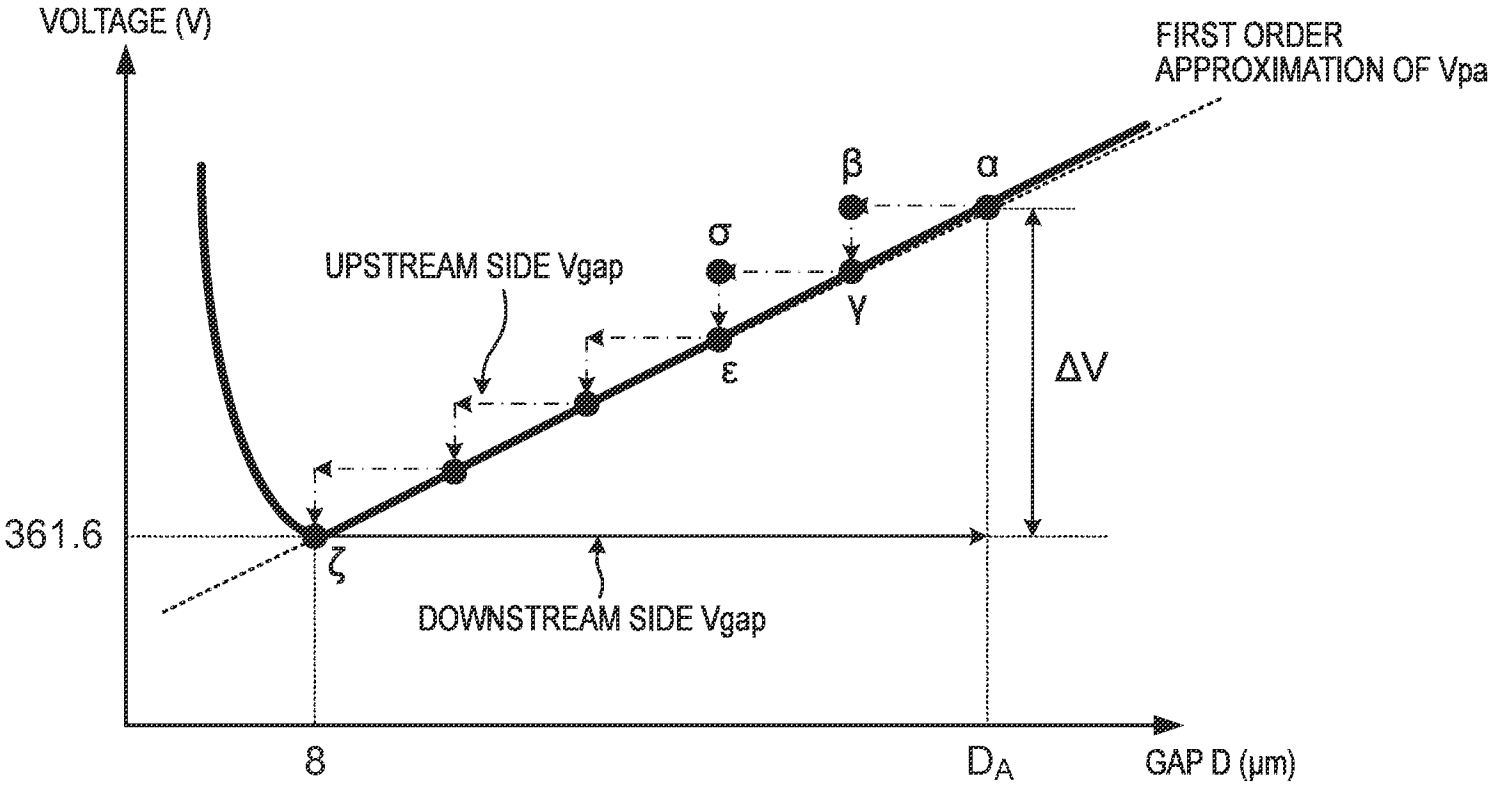
FIG. 6 is a graph showing the relationship between a gap and a discharge breakdown voltage.

A mechanism for causing the charging roller 23 to charge the photosensitive member 22 will be described using a discharge model. Note that in the following explanation, the influence of charge injection will be neglected. Assume that the resistance of the photosensitive member 22 is sufficiently high, and that of the charging roller 23 is sufficiently low. According to the Paschen's law described in R. M. Schaffert "Electrophotography", Kyoritsu Shuppan, 1973, the relationship between a gap D (μm) in air and a discharge breakdown voltage Vpa (V) is represented as shown in FIG. 6. As shown in FIG. 6, the smaller the gap D is, the lower the discharge breakdown voltage Vpa is. The discharge breakdown voltage Vpa is minimized when D=8 μm. When the gap D falls within the range of 8 μm or more, the discharge breakdown voltage Vpa and the gap D can be approximated by Vpa(D)=312+6.2D. When the gap D is 8 μm or less, the discharge breakdown voltage Vpa abruptly rises, and no discharge occurs.

In the region on the upstream side in the rotation direction of the photosensitive member 22 with respect to the nip portion between the photosensitive member 22 and the charging roller 23, the gap D between the photosensitive member 22 and the charging roller 23 gradually becomes small as the photosensitive member 22 rotates. This makes the discharge breakdown voltage Vpa gradually low. When the relationship between the discharge breakdown voltage Vpa corresponding to the gap D and a divided voltage Vgap applied to the gap D changes from a point α to a point β in FIG. 6, discharge starts. When the potential difference Vgap changes due to the discharge, and the relationship between the discharge breakdown voltage Vpa and the divided voltage Vgap transits to a point γ, the discharge stops. When the relationship between the discharge breakdown voltage Vpa and the divided voltage Vgap transits to a point δ along with the small rotation of the photosensitive member 22, the discharge starts. After that, when the potential difference Vgap changes due to the discharge, and the relationship between the discharge breakdown voltage Vpa and the divided voltage Vgap transits to a point ϵ, the discharge stops. When the start and stop of discharge in the above-described small section are repeated, the discharge continues from the point α to a point ζ.

In the above-described continuous discharge process, the discharge density is uniform at the surface position of the photosensitive member 22. This will be described below. The Paschen's law can be approximated by a linear expression. For this reason, if the gap D decreases at a predetermined rate with respect to the time, the discharge density also becomes uniform. In the discharge generation region where the discharge occurs between the photosensitive member 22 and the charging roller 23, the outer diameter of the photosensitive member 22 and that of the charging roller 23 are much larger than the gap D. Hence, the length of the photosensitive member 22 in the circumferential direction also decreases at a predetermined rate with respect to the time. Hence, the discharge density in the discharge generation region of the photosensitive member 22 in the circumferential direction can be regarded as uniform.

The discharge stops when the discharge breakdown voltage Vpa is minimized, that is, when D=8 μm in FIG. 6. At this time, Vgap is 361.6 (V). In the region on the downstream side in the rotation direction of the photosensitive member 22 with respect to the nip portion between the photosensitive member 22 and the charging roller 23, the discharge breakdown voltage Vpa rises along with the rotation of the photosensitive member 22. However, Vgap maintains the minimum value, that is, the value at the point ζ in FIG. 6. Hence, the discharge does not occur in the region on the downstream side of the nip portion. As described above, when a DC bias is applied to the charging roller 23, the discharge uniformly occurs in a certain width in the sub-scanning direction on the upstream side of the nip portion between the photosensitive member 22 and the charging roller 23 but does not on the downstream side. When the photosensitive member 22 has made one revolution, and its surface is uniformly charged to the dark potential VD, the discharge ends.

Discharge that occurs when the latent image mark 80 is formed on the photosensitive member 22 will be described next. When the latent image mark 80 charges to the bright potential VL has reached the upstream side of the nip portion, Vgap increases by ΔV=VL−VD. That is, in this example, Vgap rises by 450 V. Hence, the divided voltage Vgap is 361.6+450=811.6 (V). As in the case in which the photosensitive member 22 is charged to the dark potential VD, discharge occurs at a position where the gap $D=D_A$ in FIG. 6, and continues until D=8 (μm). In this case, since $$VL-VD+Vpa(8)=312+6.2D_A$$

$D_A$ is given by $$D_A=(VL-VD+Vpa(8)-312)/6.2=(811.6-312)/6.2=80.6\ (\mu m)$$

Figure 7:
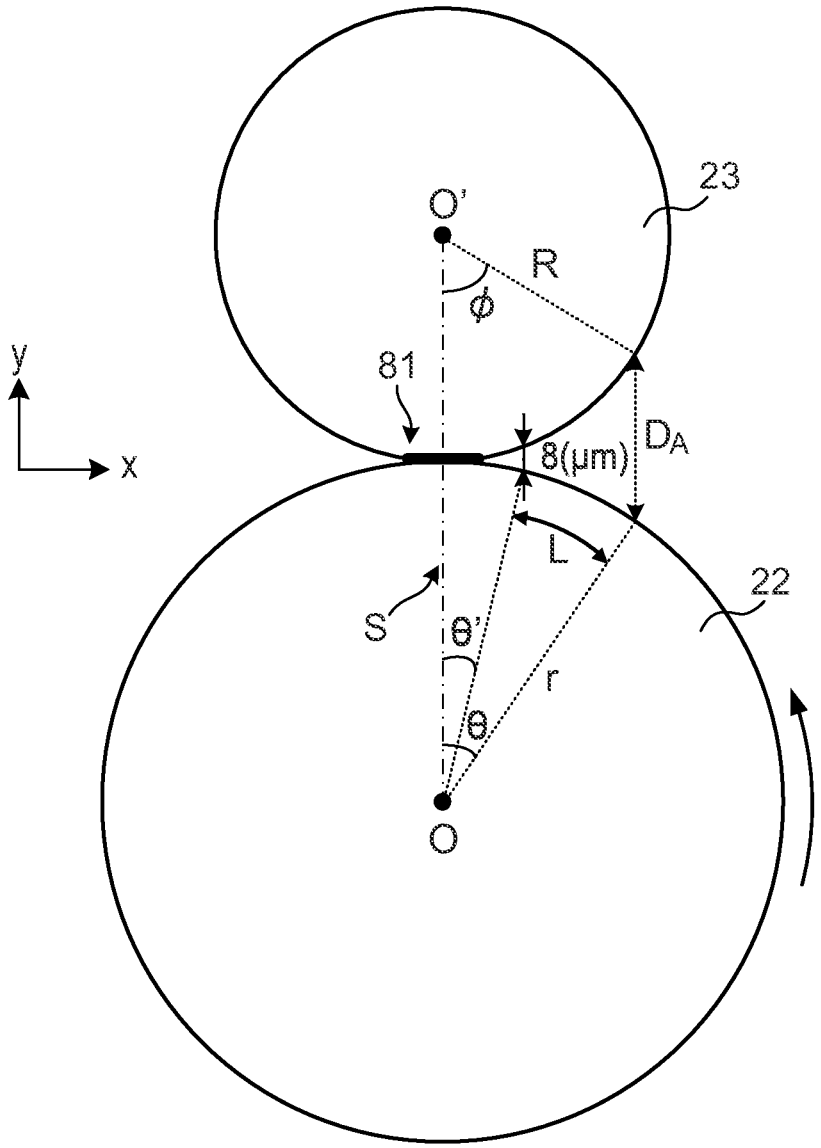
FIG. 7 is an explanatory view of a discharge generation region.

The relationship between the gap D and a width L of the discharge generation region with respect to the latent image mark 80 on the photosensitive member 22 will be described next with reference to FIG. 7. FIG. 7 illustrates a state in which the charging roller 23 having a radius R and the photosensitive member 22 having a radius r come into contact with each other at a nip portion 81, and the photosensitive member 22 rotates in the direction of the arrow. The gap D between the photosensitive member 22 and the charging roller 23 actually has a length along the line of electric force. However, the gap D is much smaller than the outer diameter of the photosensitive member 22 and is therefore approximated by a line parallel to a line S that connects a center O of the photosensitive member 22 to a center O' of the charging roller 23. Let θ be the angle made by the line S and a line from the center O to a point on the photosensitive member 22 where the discharge starts, and ϕ be the angle made by the line S and a line from the center O' to a point on the charging roller 23 where the discharge starts. In this case, $$R\cdot\sin\phi=r\cdot\sin\theta \quad \text{x direction}$$

$$R\cdot\cos\phi+r\cdot\cos\theta+D=R+r \quad \text{y direction}$$

hold for the x and y directions shown in FIG. 7.

Assume that Asker-C having a hardness of 50° is used as the charging roller 23, and the charging roller 23 is pressed against the photosensitive member 22 at a load of 1 kg weight. In this case, the penetration amount of the charging roller 23 into the photosensitive member 22 is several ten μm. Hence, the distance between the center O and the center O' is approximated by (R+r) in the above-described equations. When φ is eliminated from the above-described equations, we obtain $$\theta=\cos^{-1}((n^2-m+1)/2n))$$

where $$n=((R+r)\cdot10^3-D)/(r\cdot10^3)$$

$$m=(R/r)^2$$

It is therefore possible to obtain θ from gap $D=D_A$ at which the discharge of the latent image mark 80 starts. In a similar manner, θ' for D=8 μm that gives the minimum value of the discharge breakdown voltage can also be obtained. For example, when the outer diameter of the photosensitive member is 24 mm, and that of the charging roller 23 is 8.5 mm, the width L of the discharge generation region=r (θ−θ')=921.8 μm.

Figure 8A:
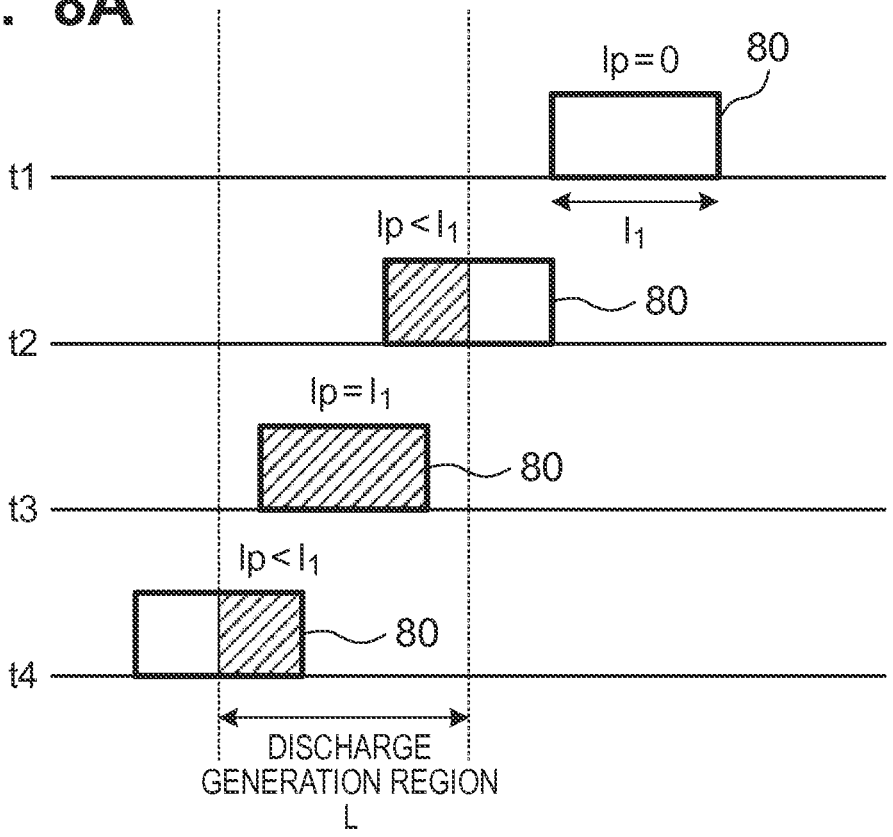
FIGS. 8A and 8B are explanatory views of a change in a detected voltage.
Figure 8B:
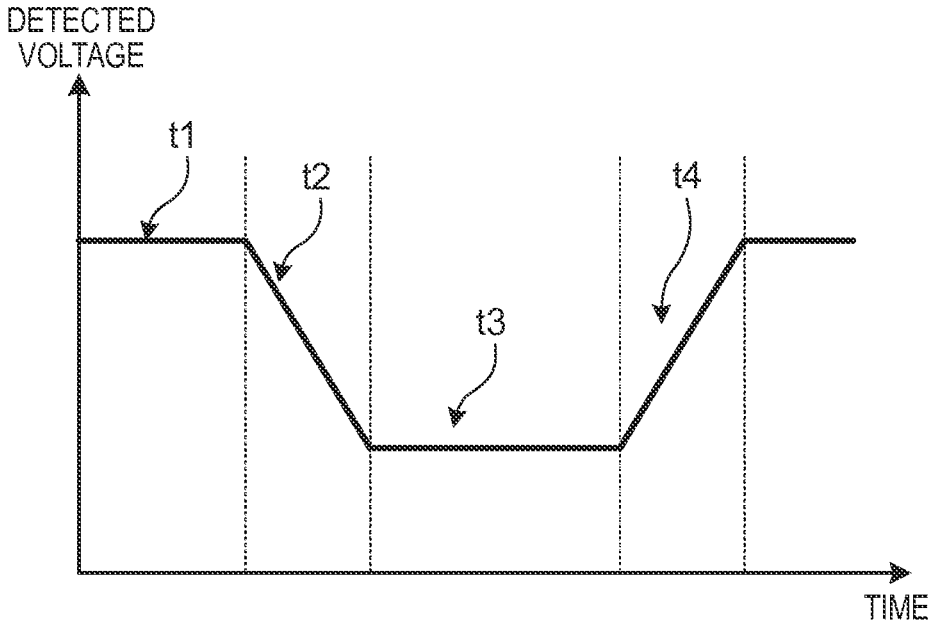

The reason why the value of the detected voltage 56 is minimized when the latent image mark 80 has reached the discharge generation region will be described below. FIG. 8A shows a time-rate change in a discharge width lp when a latent image mark having a width $l_1$ exists on the upstream side of the nip portion between the photosensitive member 22 and the charging roller 23. Note that the width is assumed to mean the width in the rotation direction of the photosensitive member 22, that is, width in the sub-scanning direction unless otherwise specified. FIG. 8A shows a state in which the latent image mark 80 approaches the nip portion on the left side of FIG. 8A as the time advances from time t1 to time t4. FIG. 8B shows the value of the detected voltage 56 at each time.

At the time t1 in FIG. 8A, the latent image mark 80 is located outside the discharge generation region. Since no discharge occurs, and the current flowing to the resistor 71 shown in FIG. 3 is constant, the detected voltage 56 is also constant. In the state at the time t2, since the area of the latent image mark 80 in the discharge generation region becomes large, the current flowing to the resistor 71 shown in FIG. 3 also increases accordingly, and therefore, the detected voltage 56 lowers. In the state at the time t3, since the latent image mark 80 is wholly located in the discharge generation region, the discharge width lp is constant at $l_1$. Hence, the current flowing to the resistor 71 in FIG. 3 does not change, and the detected voltage 56 is constant. In the state at the time t4, since the area of the latent image mark 80 in the discharge generation region becomes small, the current flowing to the resistor 71 shown in FIG. 3 also decreases accordingly, and therefore, the detected voltage 56 rises. The detected voltage 56 changes as shown in FIG. 5A due to the above-described reason.

Figure 9:
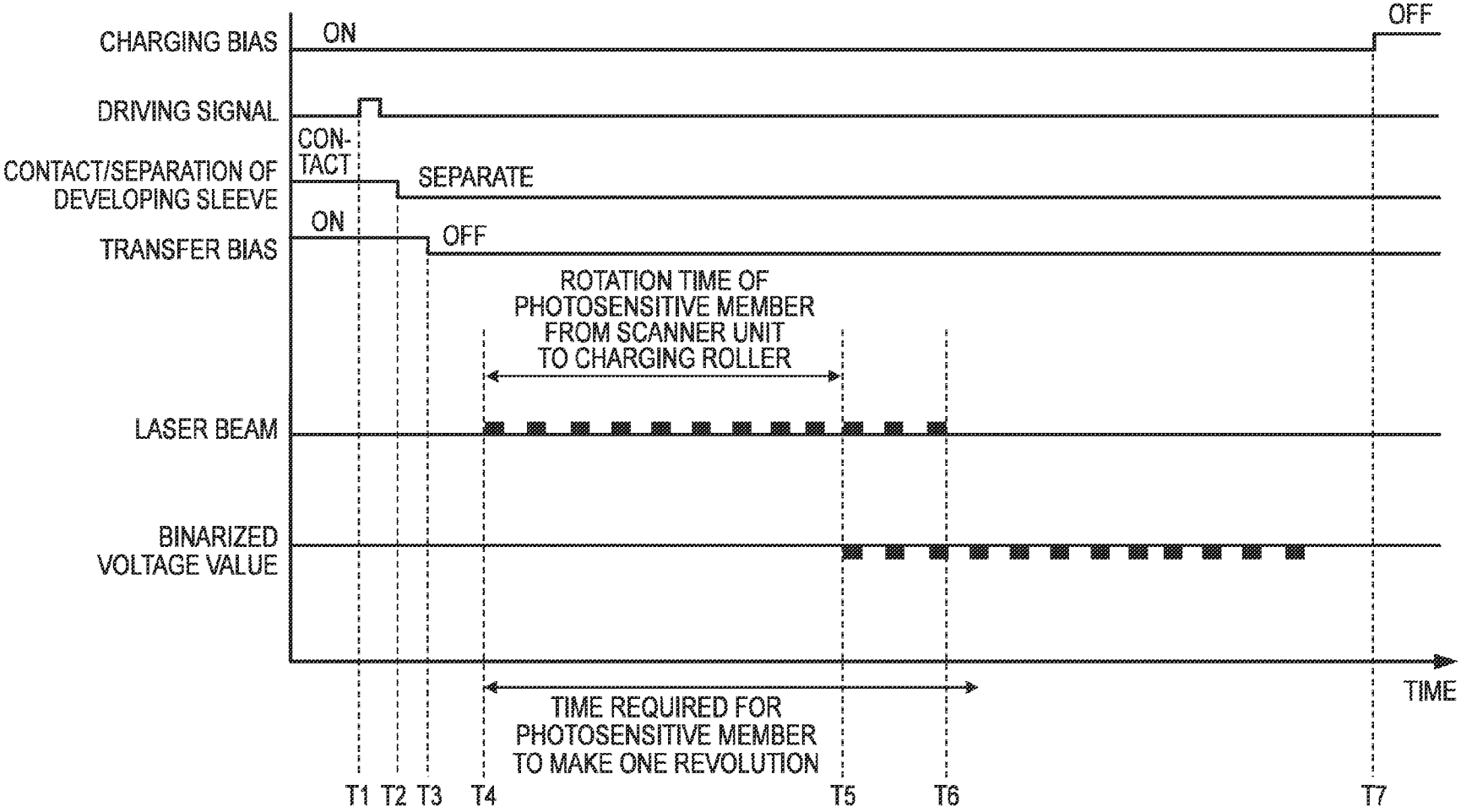
FIG. 9 is a timing chart of color misregistration correction control according to an embodiment.

FIG. 9 is a timing chart of color misregistration correction control according to this embodiment. Note that the control shown in FIG. 9 is executed for each color. At a timing T1, the control unit 54 outputs a driving signal to drive the cam to separate the developing sleeve 24. At a timing T2, the developing sleeve 24 changes to a state separated from the photosensitive member 22. At a timing T3, the control unit 54 controls the transfer bias of the primary transfer roller 26 from the on state to the off state, that is, zero. During the period of timings T4 to T6, the scanner unit 20 forms a plurality of latent image marks 80 on the photosensitive member 22 by a laser beam. Note that in FIG. 9, each black rectangular portion indicates the latent image mark 80. During the period of timings T5 to T7, the control unit 54 detects the latent image marks 80 based on the binarized voltage value 561. Note that during the time from the start of control to the time T7, the charging high-voltage power supply circuit 43 outputs the charging bias to the charging roller 23.

In this embodiment, the positional shifts of the respective colors are independently corrected. Hence, a reference value is acquired for each color in advance before execution of the above-described color misregistration correction control. This reference value acquisition may be performed in a state in which the positional shift amount between the respective colors is small after, for example, the conventional color misregistration correction control has been done by detecting an actually formed toner image by the detection sensor 40.

Reference value acquisition for a given color will be described below. To acquire the reference value, the control unit 54 forms a plurality of latent image marks 80 on the photosensitive member 22. Note that the plurality of latent image marks 80 are formed to cancel the influence of, for example, unevenness of the rotation speed of the photosensitive member 22. In the following description, 20 latent image marks 80 are formed as an example. As shown in FIG. 5A, two, leading and trailing edges are generated in the binarized voltage value 561 by one latent image mark 80. Hence, when the 20 latent image marks 80 are formed, the control unit 54 detects 40 edges for each color. The control unit 54 measures a detection time t(k) (k=1 to 40) of each edge with respect to a reference timing.

After all edges are detected, the control unit 54 obtains a reference value es by $$es=\sum_{k=1}^{20}(t(2k-1)+t(2k))/2 \quad (1)$$

and stores it. Note that equation (1) totalizes the detection times of the intermediate positions of the edges of the respective latent image marks 80.

Figure 10:
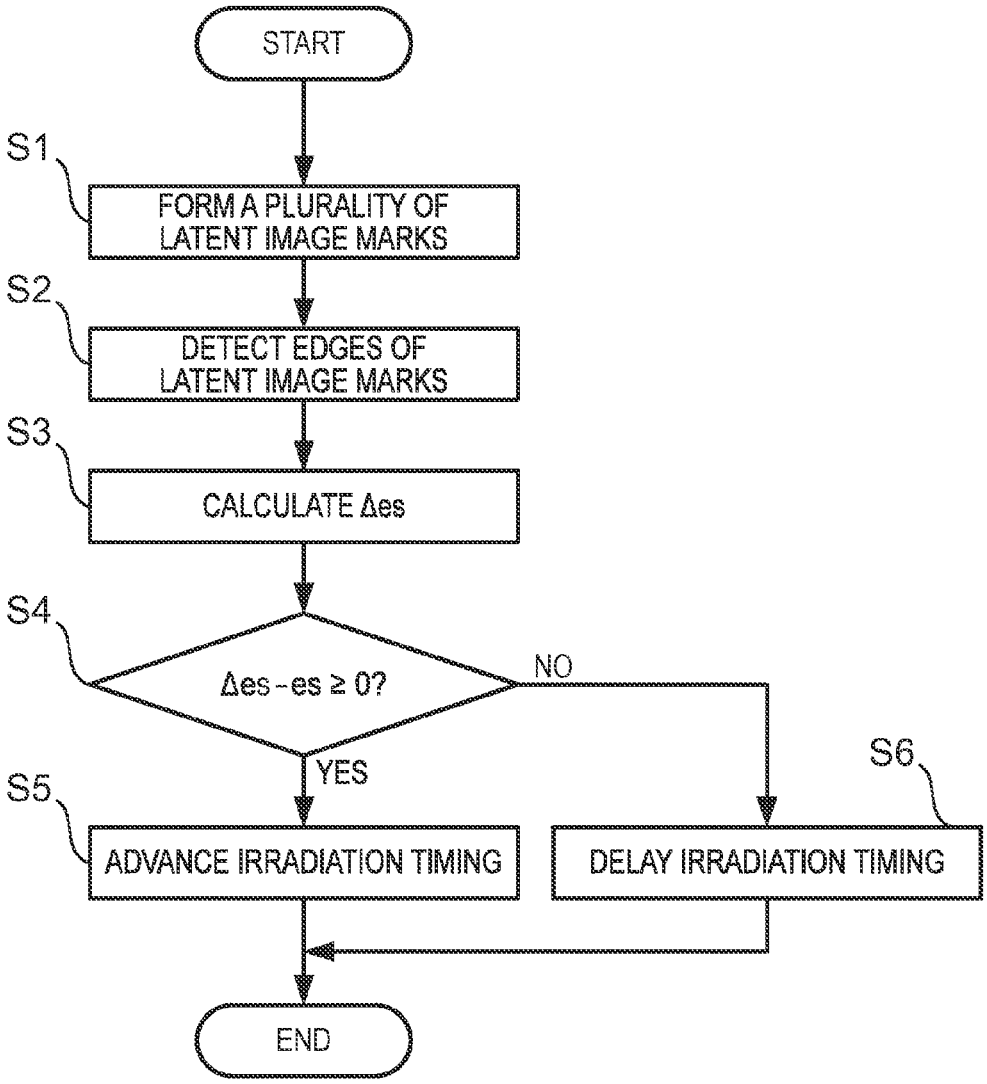
FIG. 10 is a flowchart of color misregistration correction control according to an embodiment.

FIG. 10 is a flowchart of color misregistration correction control. When the color misregistration correction starts, the control unit 54 forms the latent image marks 80 as many as those in acquiring the reference value, for example, 20 latent image marks 80 on the photosensitive member 22 in step S1. In step S2, the control unit 54 detects the leading and trailing edges of the latent image marks 80 based on the change in the detected current of the current detection circuit 50, and measures the detection time t(i) of each edge with respect to the same reference timing as that when acquiring the reference value. In step S3, the control unit 54 calculates Δes by $$\Delta es = \sum_{i=1}^{20} (t(2i-1) + t(2i))/2 \quad (2)$$

In step S4, the control unit 54 determines whether a value obtained by subtracting the reference value es from Δes is 0 or more. If the value obtained by subtracting the reference value es from Δes is 0 or more, this indicates that the laser beam irradiation timing of the scanner unit 20 corresponding to the color delays with respect to the reference value. In this case, in step S5, the control unit 54 advances the laser beam irradiation timing of the scanner unit 20 corresponding to the color. Note that the amount to be advanced corresponds to the value obtained by subtracting the reference value es from Δes. On the other hand, if the value obtained by subtracting the reference value es from Δes is smaller than 0, this indicates that the laser beam irradiation timing of the scanner unit 20 corresponding to the color advances with respect to the reference value. In this case, in step S6, the control unit 54 delays the laser beam irradiation timing of the scanner unit 20 corresponding to the color. Note that the amount to be delayed also corresponds to the difference between Δes and the reference value es. Performing the above-described processing for the respective colors enables to correct the positional shift between the toner images of the respective colors.

A method of accurately detecting the periodically formed latent image marks 80 will be explained next. FIGS. 11A to 11E are timing charts showing time-rate changes in the detected voltage 56 when the width of each latent image mark 80 and the interval between the latent image marks 80 adjacent in the sub-scanning direction are set to 10, 20, 30, 40, and 50 dots at 600 dpi.

Figure 11A:
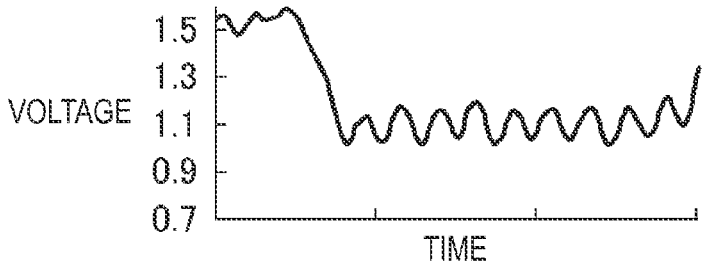
FIGS. 11A to 11E are timing charts showing time-rate changes in the detected voltage for latent image marks formed in various widths and intervals.
Figure 12A:
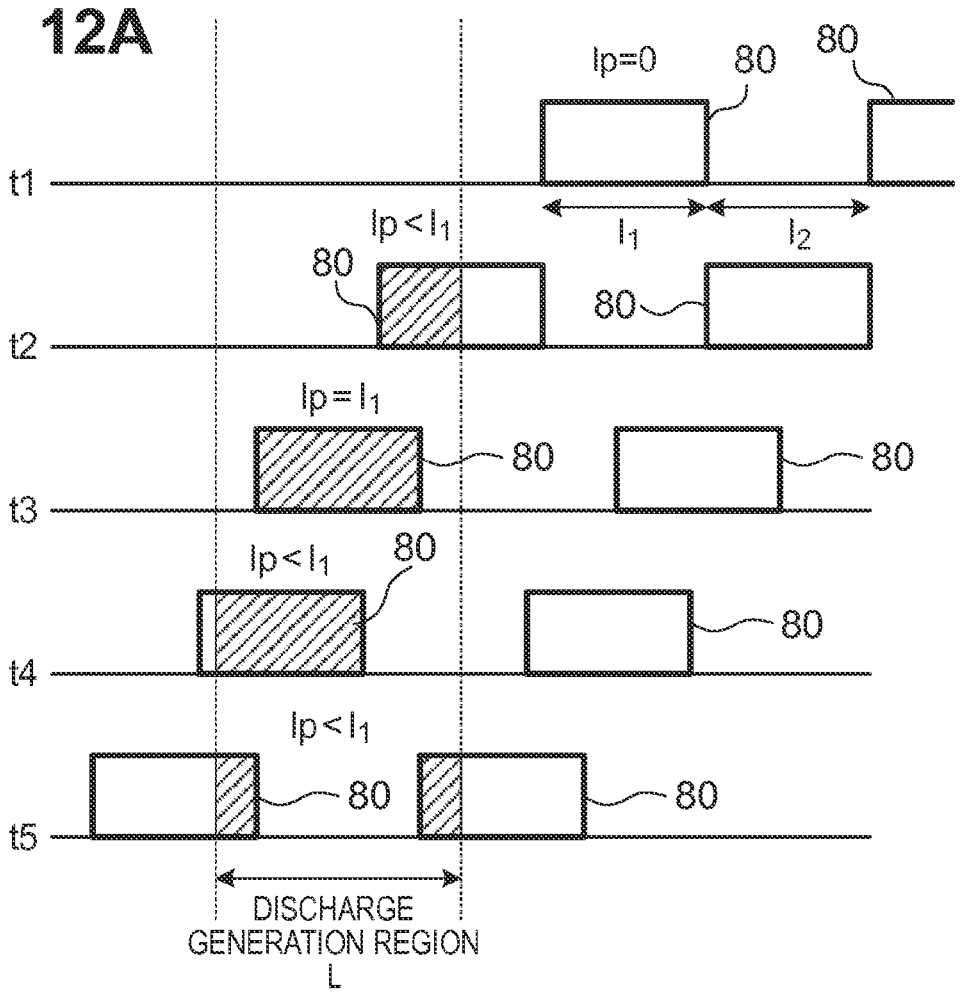
FIGS. 12A and 12B are views for explaining that the amplitude of the detected voltage becomes small depending on the interval of the latent image marks.
Figure 12B:
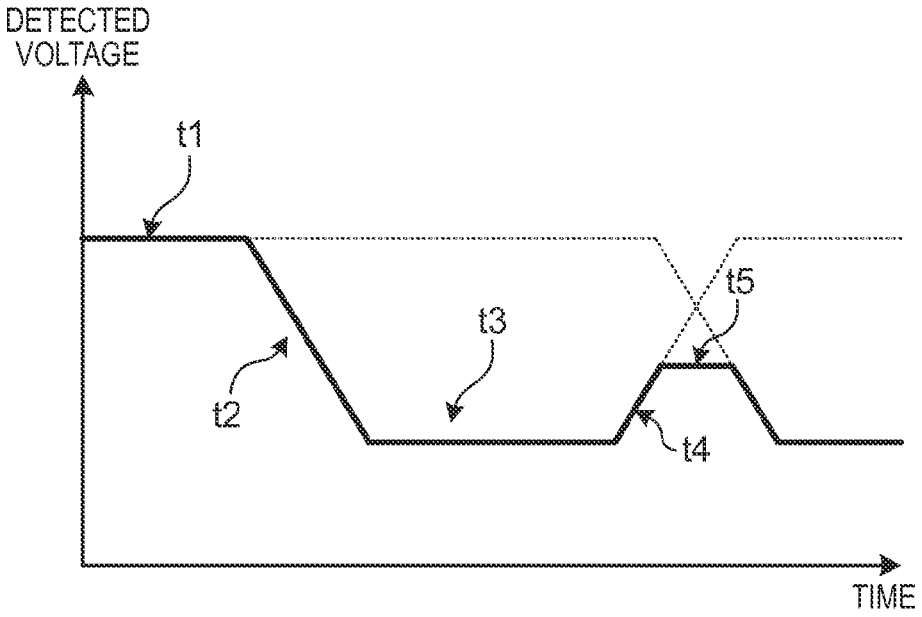

When the width and interval of the latent image marks 80 are 10 dots, the amplitude of the detected voltage 56 becomes small in the second half, as is apparent from FIG. 11A. The reason for this will be described with reference to FIGS. 12A and 12B. FIG. 12A shows a state in which the latent image marks 80 each having the width $l_1$ in the sub-scanning direction are formed at an interval $l_2$. For example, $l_1$ and $l_2$ are 10 dots=423 μm, and the width L of the discharge generation region is 921.8 μm.

Times t1 to t4 in FIG. 12A are the same as the times t1 to t4 in FIG. 8A, and a description thereof will be omitted. At a time t5 in FIG. 12A, the area of the latent image mark 80 that enters the discharge generation region and that of the latent image mark 80 that leaves the discharge generation region equal, and the area of the latent image marks 80 in the discharge generation region does not change. Hence, the current flowing to the resistor 71 shown in FIG. 3 does not change either, and the detected voltage 56 is constant. The states at the times t2 to t5 are repeated from then on.

As described above, when the interval $l_2$ of the latent image marks 80 is smaller than the discharge generation region, a situation occurs in which at the same time as one of the adjacent latent image marks 80 leaves the discharge generation region, the other enters the discharge generation region. During this time, the currents overlap, and the decrease in the current flowing to the resistor 71 shown in FIG. 3 stops. Hence, the amplitude of the detected voltage becomes small. The dotted lines in FIG. 12B indicate the detected voltage when the two adjacent latent image marks 80 are formed alone.

Figure 11B:
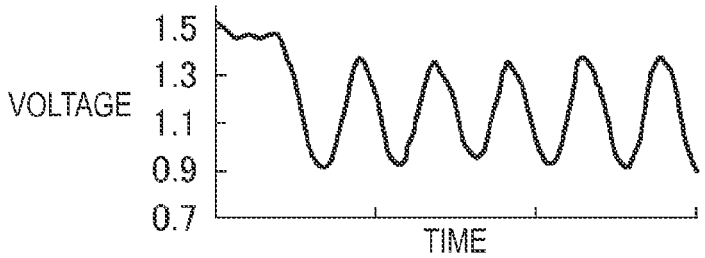

That is, to avoid the decrease in the amplitude of the detected voltage 56 caused by the overlap of the currents, the interval between the latent image marks 80 adjacent to each other is set to be equal to or larger than the width L of the discharge generation region, that is, $l_2 \geq L$. In the case of 20 dots, the interval $l_2$ is 826 μm which is smaller than the width L (921.8 μm) of the discharge generation region. Hence, the detected voltage 56 becomes small, as shown in FIG. 11B.

As described above, when the interval of the latent image marks 80 adjacent to each other in the rotation direction of the photosensitive member is set to be equal to or larger than the width of the discharge generation region, not a plurality of latent image mark 80 enter the discharge generation region simultaneously. It is therefore possible to accurately detect the latent image marks 80.

Figure 11C:
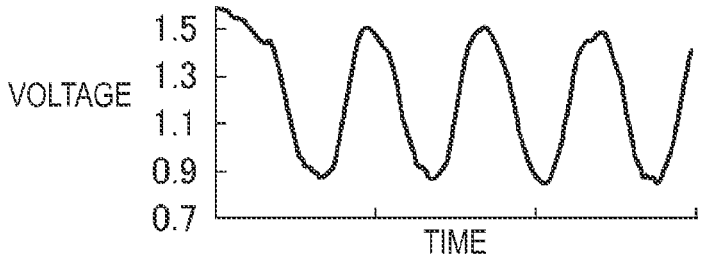
Figure 11D:
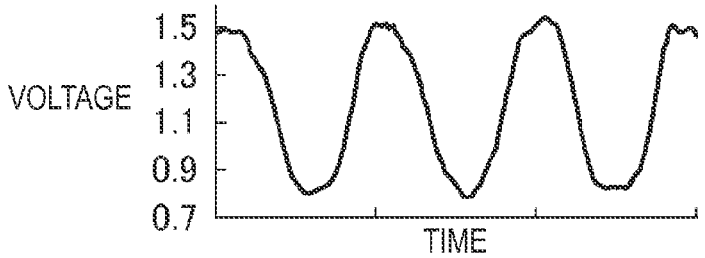
Figure 11E:
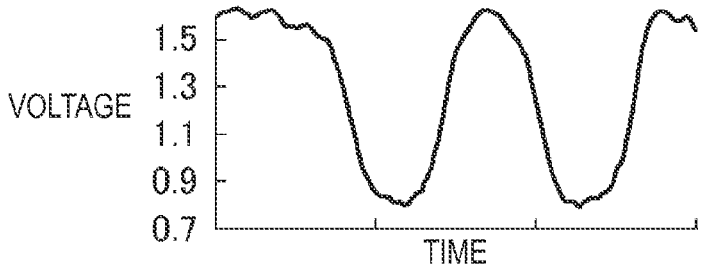
Figure 13:
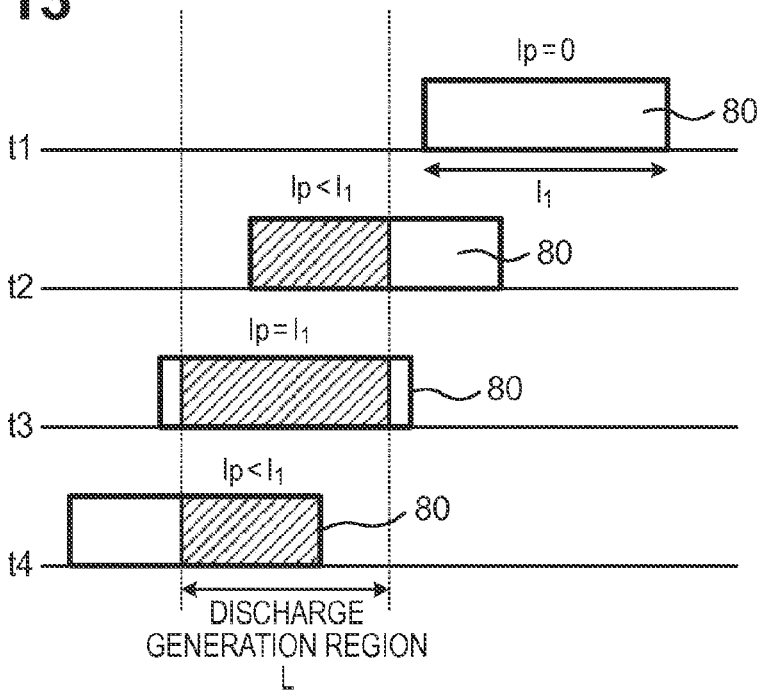
FIG. 13 is a view showing a case in which the interval of the latent image marks is larger than in the discharge generation region.

On the other hand, when the interval $l_2$ is 30 to 50 dots, that is, larger than the width L of the discharge generation region, the situation which at the same time as one of the adjacent latent image marks 80 leaves the discharge generation region, the other enters the discharge generation region does not occur, as shown in FIG. 13. Hence, as shown in FIGS. 11C to 11E, the maximum value of the detected voltage 56 is about 1.5 V, which is larger than in the states shown in FIGS. 11A and 11B. This is because the width $l_1$ of the latent image mark 80 is larger than the width L of the discharge generation region, as indicated by the time t3 in FIG. 13, and a state in which the discharge width lp equals L exists. That is, to cause discharge simultaneously in the whole discharge generation region and make the increase/decrease in the detected voltage 56 large, the width of the latent image mark 80 is set to be equal to or larger than the width L of the discharge generation region such that the relationship $l_1 \geq L$ holds.

As described above, when the width of the latent image mark 80 is equal to or larger than the width L of the discharge generation region, discharge occurs simultaneously in the whole discharge generation region. It is therefore possible to accurately detect the latent image marks 80.

Note that in the case of 30 dots shown in FIG. 11C, the minimum value of the detected voltage 56 is about 0.9 V, which is larger than the minimum value of about 0.8 V for 40 dots and 50 dots shown in FIGS. 11D and 11E. That is, the change amount of the detected voltage is smaller than in the case of 40 dots or 50 dots. This is supposedly because VL is not sufficiently high at en edge of the latent image mark 80, and the discharge does not occur in the whole discharge generation region. That is, since lp<L, the current flowing to the resistor 71 shown in FIG. 3 is not maximized.

The reason why lp<L although $l_1$>L in the case of 30 dots will be described below. There is an error between the width of a light emission region em1 estimated from the light emission time of the laser and the width $l_1$ of the latent image mark 80 on the photosensitive member 22, and normally, a relationship given by $l_1$<em1 holds. Hence, in light emission for 30 dots, $l_p$<L is considered to hold.

Similarly, an error occurs between the sub-scanning direction width of a non-light emission region em2 of the laser and the interval $l_2$ between the latent image marks 80 on the photosensitive member 22 as well, and a relationship given by $l_2$>em2 holds. Hence, when the width of the non-light emission region of the laser is set to be equal to or larger than the width L of the discharge generation region, that is, em2≥L, the amplitude of the detected voltage 56 can be prevented from becoming small. Note that the above description applies not only to a case in which charge movement from the charging roller 23 to the photosensitive member 22 occurs due to discharge but also to a case to be described below in which the charges move via the nip portion between the charging roller 23 and the photosensitive member 22. In the above-described embodiment, the charging roller 23 may have a non-cylindrical shape such as a plate shape.

Thus making the width of the non-light emission region of the laser equal to or larger than the width of the discharge generation region makes it possible to prevent the amplitude of the detected voltage 56 from becoming small and accurately detect the latent image marks 80.

A case in which the current flows from the photosensitive member 22 to the charging high-voltage power supply circuit 43 via the charging roller 23 not due to discharge but via the contact portion (to be referred to as the nip portion 81 hereinafter) between the photosensitive member 22 and the charging roller 23. In this case, the larger the area of the nip portion between the charging roller 23 and the latent image mark 80 is, the larger the current flowing between the charging roller 23 and the photosensitive member 22 is. Hence, the change amount of the detected voltage 56 also becomes large. That is, the change amount of the detected voltage 56 is maximized when the nip portion 81 between the charging roller 23 and the photosensitive member 22 is wholly covered by the latent image mark 80.

Figure 14:
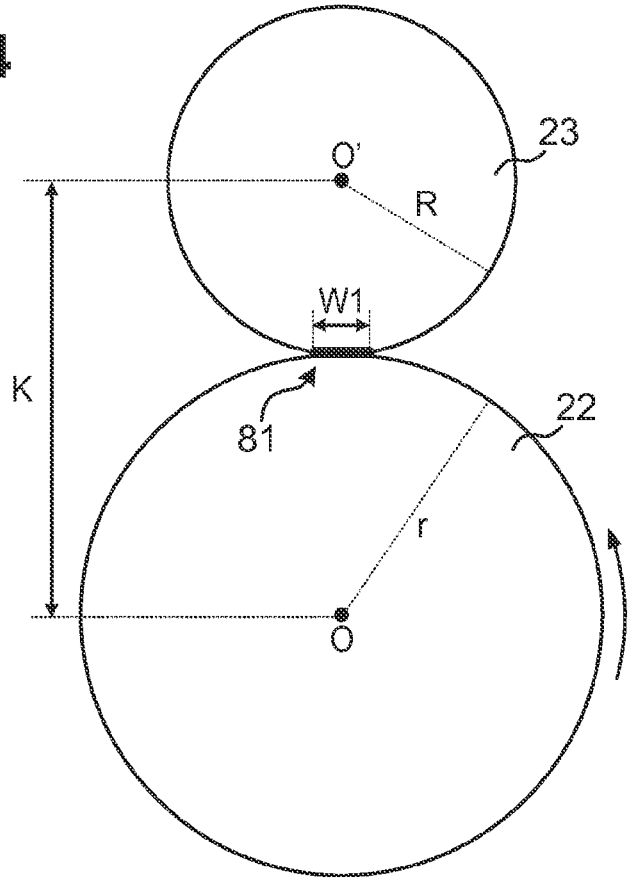
FIG. 14 is an explanatory view of the width of a nip portion.

As shown in FIG. 14, let R be the radius of the charging roller 23, r be the radius of the photosensitive member 22, and K be the distance between the center of the charging roller 23 and that of the photosensitive member 22. In this case, a sub-scanning direction width w1 of the nip portion 81 is given by $$w1=r\cdot\cos^{-1}((r^2-R^2+4K^2)/4rK)$$

Figure 15A:
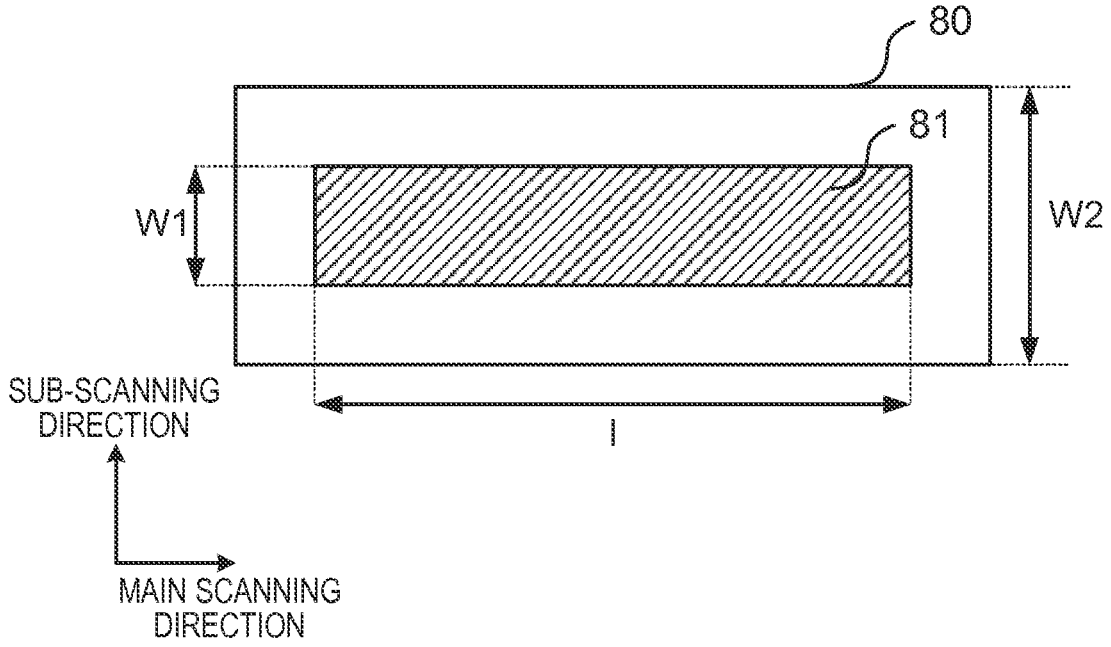
FIGS. 15A and 15B are views showing the relationship between a latent image mark formation region and a charge moving region according to an embodiment.
Figure 15B:
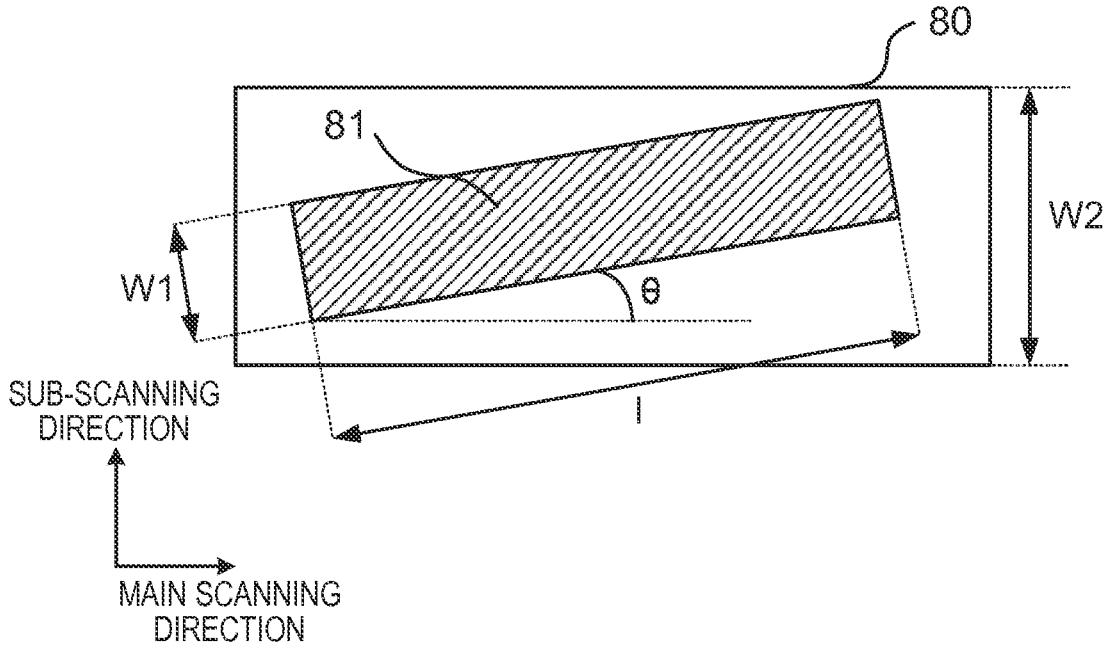

FIGS. 15A and 15B are views showing the relationship between the nip portion 81 and the latent image mark 80. To obtain a satisfactory detection result, a sub-scanning direction width w2 of the latent image mark 80 is set to be wider than the sub-scanning direction width w1 of the nip portion 81, as shown in FIG. 15A. The main scanning direction width of the latent image mark 80 is also set to be wider than the main scanning direction width of the nip portion 81.

Note that FIG. 15B shows a state in which the latent image mark 80 tilts with respect to the nip portion 81. The irradiation position of the scanner unit 20 is known to have a deviation or small tilt due to a change in the temperature inside the apparatus caused by continuous printing or the like. The nip portion 81 is also known to have a positional shift or small tilt due to a variation in the component size or a change in the temperature in the apparatus. Even in this case, when the nip portion 81 is configured to be wholly covered by the latent image mark 80, the change amount of the detected voltage 56 is maximized, and a satisfactory detection result can be obtained.

For example, let θ be the tilt amount of the latent image mark 80 with respect to the nip portion 81. Note that the reference direction of the tilt amount is set to the main scanning direction, as shown in FIG. 15B. Let l be the length of the nip portion 81 in the main scanning direction and w1 be the width in the sub-scanning direction. In this case, the width w2 of the latent image mark 80 is set to be at least $w1+l\cdot\tan\theta$, thereby maximizing the change amount of the detected voltage 56.

Note that the case in which the current flowing from the photosensitive member 22 to the charging high-voltage power supply circuit 43 via the charging roller 23 is generated by discharge and the case in which the current flows via the nip portion have separately been described above. However, these cases may occur simultaneously. That is, a charge movement region in which the charges move between the photosensitive member 22 and the charging roller 23 can be considered without any awareness of whether the current flows due to discharge or via the nip portion. The description about the discharge generation region or the nip portion 81 also applies to the charge movement region.

As described above, the interval between the latent image marks 80 (first electrostatic latent image for correction and second electrostatic latent image for correction) that are adjacent to each other in the rotation direction of the photosensitive member and are used when performing color misregistration correction control is set to be equal to or larger than the width L of the discharge generation region, or the width of the latent image mark 80 is set to be equal to or larger than the width L of the discharge generation region. This allows to accurately detect the latent image marks 80. Since the latent image marks 80 can accurately be detected, the positional shift of an image can also accurately be corrected.

Second Embodiment

Figure 16:
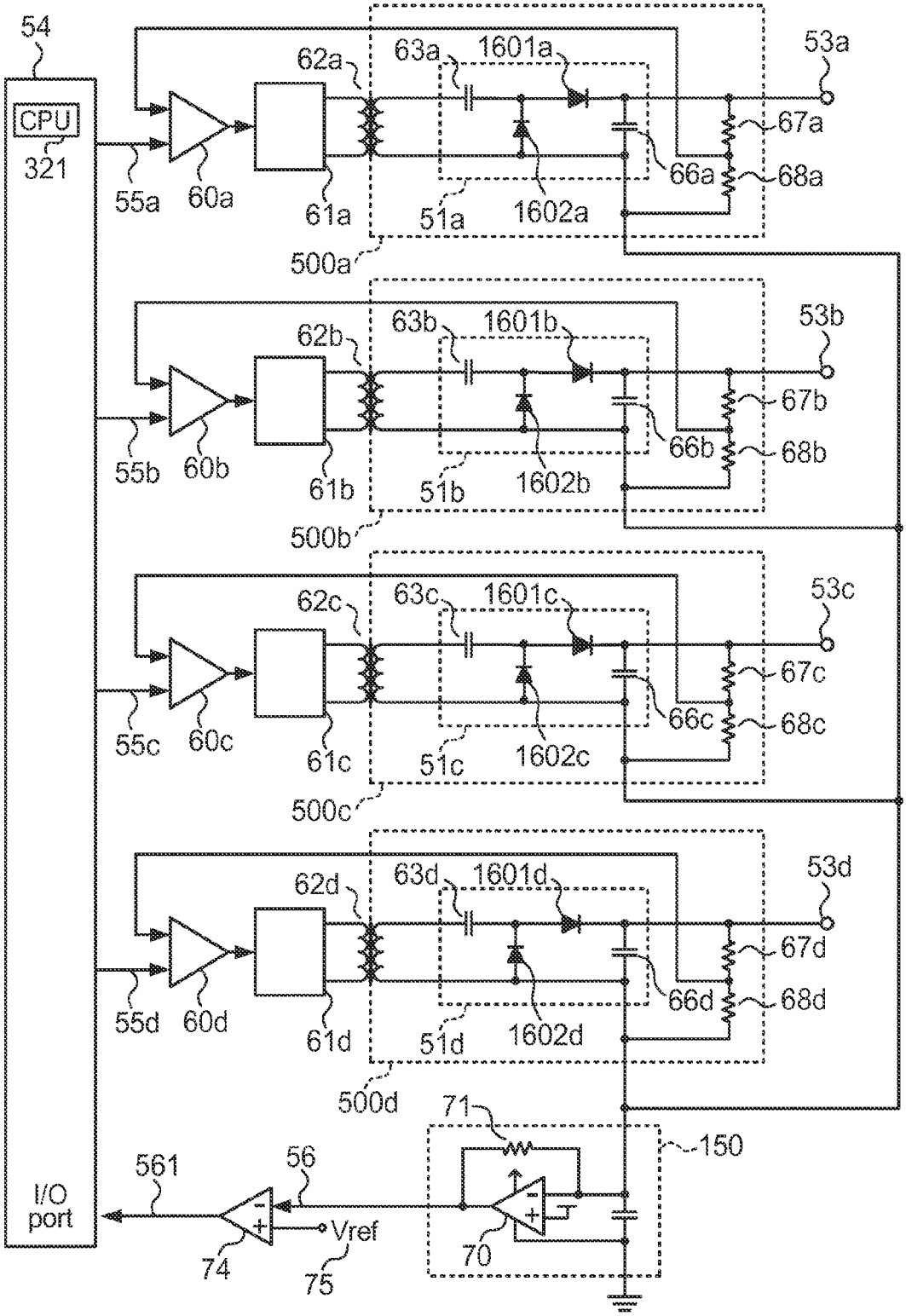
FIG. 16 is a circuit diagram showing a primary transfer high-voltage power supply circuit according to an embodiment.

In this embodiment, a primary transfer high-voltage power supply circuit 46 that applies a voltage to a primary transfer roller 26 detects a latent image mark 80. FIG. 16 is a circuit diagram showing the arrangement of the primary transfer high-voltage power supply circuit 46. Note that in this embodiment, the primary transfer high-voltage power supply circuit 46 is configured to apply a voltage to all of primary transfer rollers 26*a* to 26*d* shown in FIG. 2. That is, the primary transfer high-voltage power supply circuit 46 according to this embodiment is formed by integrating primary transfer high-voltage power supply circuits 46*a* to 46*d* shown in FIG. 2 into one circuit. In the primary transfer high-voltage power supply circuit 46, the anodes and cathodes of diodes 1601 and 1602 are set in directions reverse to those in a charging high-voltage power supply circuit 43 shown in FIG. 3. This is because the polarity of the potential to be applied is opposite to that in the charging high-voltage power supply circuit 43. Note that output terminals 53*a* to 53*d* are output terminals to the primary transfer rollers 26*a* to 26*d*, respectively. In this embodiment, a current detection circuit 150 is commonly provided for the circuits that apply voltages to the primary transfer rollers 26 of the respective colors, as shown in FIG. 16. Hence, a detected voltage 56 has a value corresponding to the sum of the currents flowing to the output terminals 53*a* to 53*d*.

Color misregistration correction control according to this embodiment will be described next mainly concerning the difference from the first embodiment. In this embodiment, the latent image mark 80 is detected by the current detection circuit 150 that detects the current flowing to the primary transfer roller 26. Note that the current is generated by discharge, charge movement via the nip portion, and both of them, as in the first embodiment. In this embodiment, the primary transfer roller 26 is placed in contact with a photosensitive member 22. A developing sleeve 24 is also placed in contact with the photosensitive member 22, and the developing bias is turned off (zero) or set to a polarity opposite to the usual, thereby preventing a toner from being applied to the latent image mark 80. The toner may be applied to some extent depending on the influence of ambient conditions. Even in this case, the latent image mark 80 can be detected. Note that the developing sleeve 24 may be separated from the photosensitive member, as in the first embodiment.

Figure 17A:
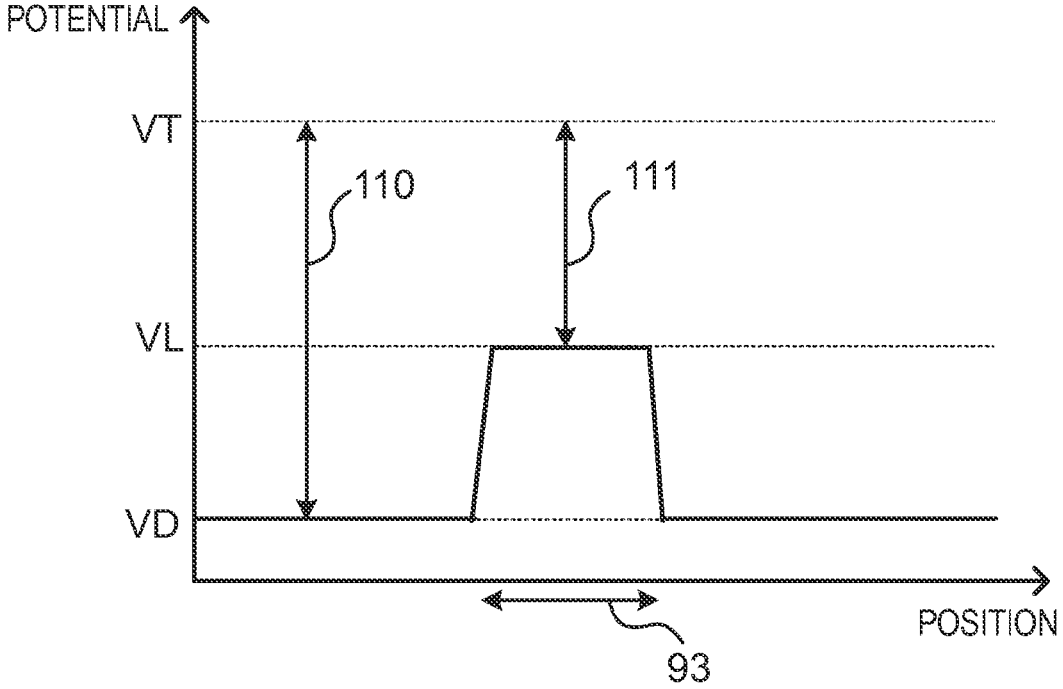
FIGS. 17A and 17B are graphs showing the potential difference between the surface potential of a photosensitive member and a primary transfer roller.

FIG. 17A shows the potential difference between the photosensitive member 22 and the primary transfer roller 26 when no toner is applied to the latent image mark 80. FIG.

Figure 17B:
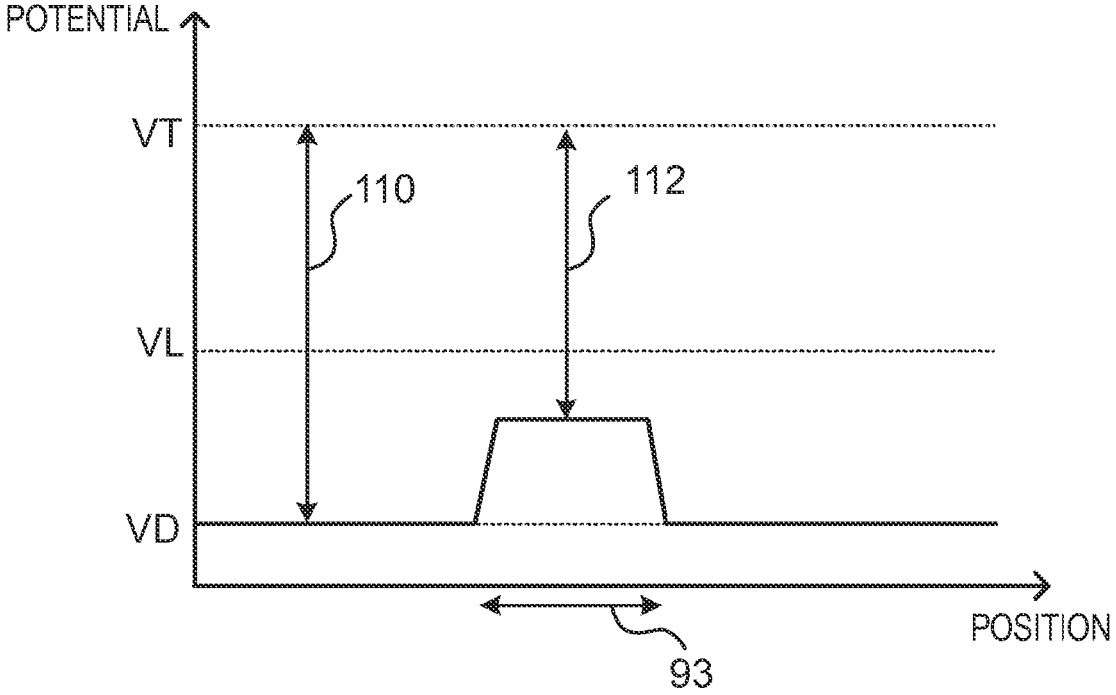

17B shows the potential difference when a toner is applied to the latent image mark 80. In FIGS. 17A and 17B, the ordinate represents the potential. Let VD be the dark potential (for example, −700 V) of the photosensitive member 22, VL be the bright potential (for example, −100 V), and VT be the transfer potential (for example, +1000 V) of the primary transfer roller 26. In a region 93 of the latent image mark 80, a potential difference 112 between the primary transfer roller 26 and the photosensitive member 22 when the toner is applied is larger than a potential difference 111 when no toner is applied. For this reason, the difference from a potential difference 110 in the remaining region becomes small. Hence, the larger the applied toner amount is, the smaller the current change in the region of the latent image mark 80 is. However, if the toner amount is small, the current change can be detected.

Figure 18:
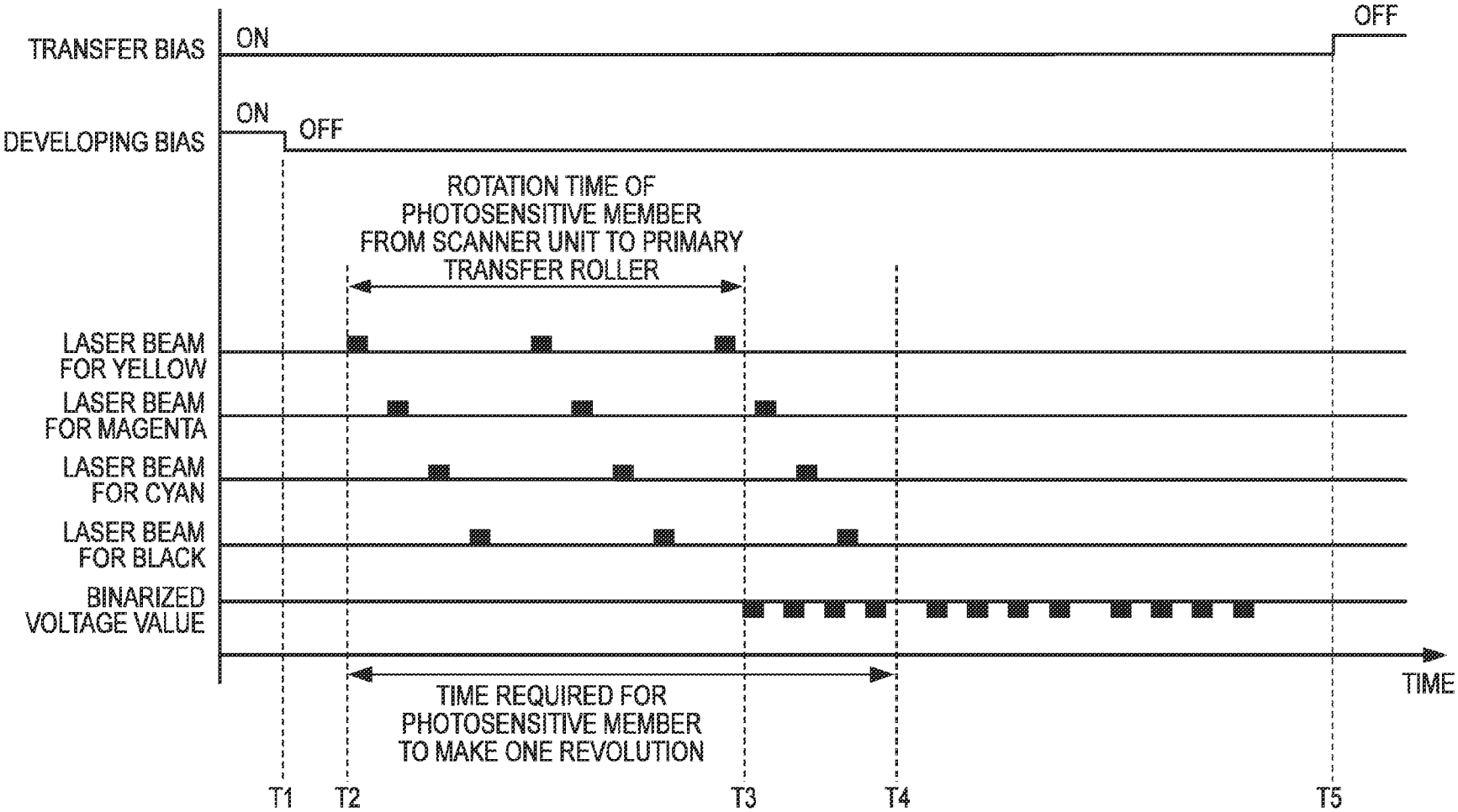
FIG. 18 is a timing chart of color misregistration correction control according to an embodiment.

FIG. 18 is a timing chart of color misregistration correction control according to this embodiment. At a timing T1, a control unit 54 turns off the developing bias to be output from a developing high-voltage power supply circuit 44 to the developing sleeve 24. During the period of timings T2 to T4, the control unit 54 forms the latent image marks 80 on the photosensitive members 22 of the respective colors by laser beams. Note that in this embodiment, since the current detection circuit 150 is common to the respective colors, the latent image marks 80 of the respective colors are formed so as to come to the position of the primary transfer roller 26 at different timings. The control unit 54 detects the latent image marks 80 on the respective photosensitive members during the period of timings T3 to T5. Note that during the time from the start of control to the time T5, the primary transfer high-voltage power supply circuit 46 applies a transfer bias to the primary transfer roller 26.

In this embodiment as well, a reference value is acquired in advance before execution of the color misregistration correction control. The reference value is acquired by forming a plurality of latent image marks 80 on each photosensitive member 22 and measuring the detection time of each edge with respect to the reference timing, as in the first embodiment. Note that in the following description, 20 latent image marks 80 are formed on each photosensitive member 22 as an example. In this embodiment, yellow is set as the reference color, and the relative positional shifts of the colors other than the reference color with respect to the reference color are corrected. Hence, reference values esYM, esYC, and esYBk of magenta, cyan, and black are obtained by $$esYM = \sum_{k=1}^{20} tm(2k-1) + tm(2k)) \Big/ 2 - \sum_{k=1}^{20} ty(2k-1) + ty(2k)) \Big/ 2 \tag{5}$$

$$esYC = \sum_{k=1}^{20} tc(2k-1) + tc(2k)) \Big/ 2 - \sum_{k=1}^{20} ty(2k-1) + ty(2k)) \Big/ 2 \tag{6}$$

$$esYBk = \sum_{k=1}^{20} tbk(2k-1) + tbk(2k)) \Big/ 2 - \sum_{k=1}^{20} ty(2k-1) + ty(2k)) \Big/ 2 \tag{7}$$

and saved.

Note that in equation (5), tm(k) is the detection time of the latent image mark 80 on a photosensitive member 22*b* corresponding to magenta, and ty(k) is the detection time of the latent image mark 80 on a photosensitive member 22*a* corresponding to yellow. Similarly, in equations (6) and (7), tc(k) and tbk(k) are the detection times of the latent image marks 80 on a photosensitive member 22*c* corresponding to cyan and a photosensitive member 22*d* corresponding to black, respectively. Note that ty(k) is the same as in equation (5).

Figure 19:
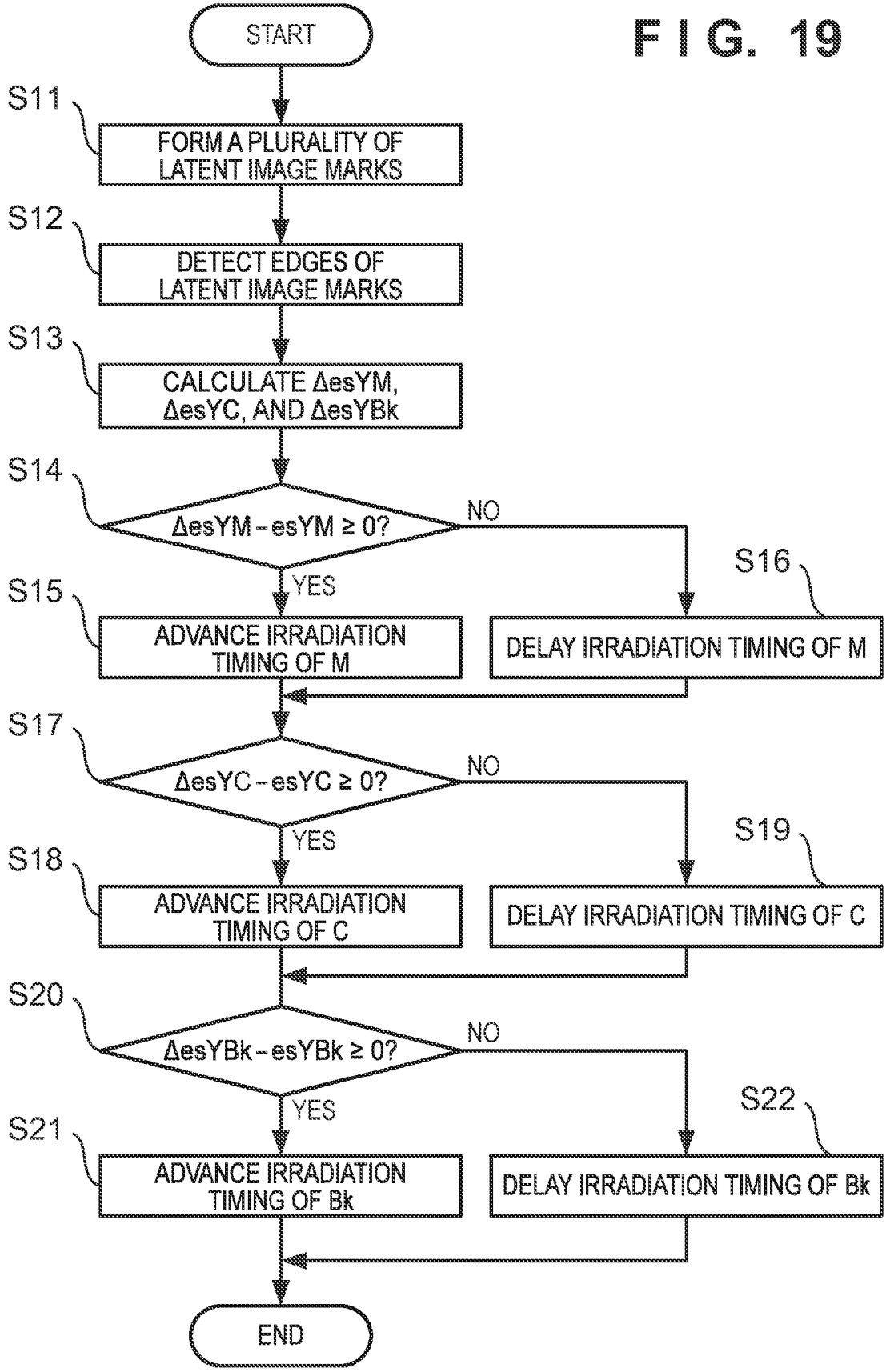
FIG. 19 is a flowchart of color misregistration correction control according to an embodiment.

FIG. 19 is a flowchart of color misregistration correction control according to this embodiment. When the color misregistration correction starts, the control unit 54 forms the latent image marks 80 as many as those in acquiring the reference value, for example, 20 latent image marks 80 on each photosensitive member 22 in step S11. In step S12, the control unit 54 detects the leading and trailing edges of the latent image marks 80 based on the change in the current value detected by the current detection circuit 150. More specifically, the control unit 54 measures detection times ty(i), tm(i), tc(i), and tbk(i) of the edges with respect to the same reference timing as that when acquiring the reference value. In step S13, the control unit 54 calculates ΔesYM, ΔesYC, ΔesYBk by $$\Delta esYM = \sum_{i=1}^{20} tm(2i-1) + tm(2i)) \Big/ 2 - \sum_{i=1}^{20} ty(2i-1) + ty(2i)) \Big/ 2 \tag{8}$$

$$\Delta esYC = \sum_{i=1}^{20} tc(2i-1) + tc(2i)) \Big/ 2 - \sum_{i=1}^{20} ty(2i-1) + ty(2i)) \Big/ 2 \tag{9}$$

$$\Delta esYBk = \sum_{i=1}^{20} tbk(2i-1) + tbk(2i)) \Big/ 2 - \sum_{k=1}^{20} ty(2i-1) + ty(2i)) \Big/ 2 \tag{10}$$

In step S14, the control unit 54 determines whether a value obtained by subtracting the reference value esYM from ΔesYM is 0 or more. If the value obtained by subtracting the reference value esYM from ΔesYM is 0 or more, this indicates that the laser beam irradiation timing of a scanner unit 20*b* for magenta delays with respect to that of a scanner unit 20*a* serving as the reference. Hence, in step S15, the control unit 54 advances the laser beam irradiation timing of the scanner unit 20*b*. Note that the amount to be advanced corresponds to the value obtained by subtracting the reference value esYM from ΔesYM. On the other hand, if the value obtained by subtracting the reference value esYM from ΔesYM is smaller than 0, this indicates that the laser beam irradiation timing of the scanner unit 20*b* corresponding to the magenta advances with respect to that of the scanner unit 20*a* serving as the reference. Hence, in step S16, the control unit 54 delays the laser beam irradiation timing of the scanner unit 20*b*. Note that the amount to be delayed also corresponds to the difference between ΔesYM and the reference value esYM. The control unit 54 performs the same processing as that for magenta for a scanner unit 20*c* corresponding to cyan in steps S17 to S19 and for a scanner unit 20*d* corresponding to black in steps S20 to S22.

Even when the primary transfer high-voltage power supply circuit 46 that applies a voltage to the primary transfer roller 26 detects the latent image mark 80, as described above, the interval between the latent image marks 80 that are adjacent to each other in the rotation direction of the photosensitive member and are used when performing color misregistration correction control is set to be equal to or larger than a width L of the discharge generation region. In addition to or instead of this, the width of the latent image mark 80 is set to be equal to or larger than the width L of the discharge generation region. This allows to accurately detect the latent image marks 80. Since the latent image marks 80 can accurately be detected, the positional shift of an image can also accurately be corrected.

Third Embodiment

Figure 20:
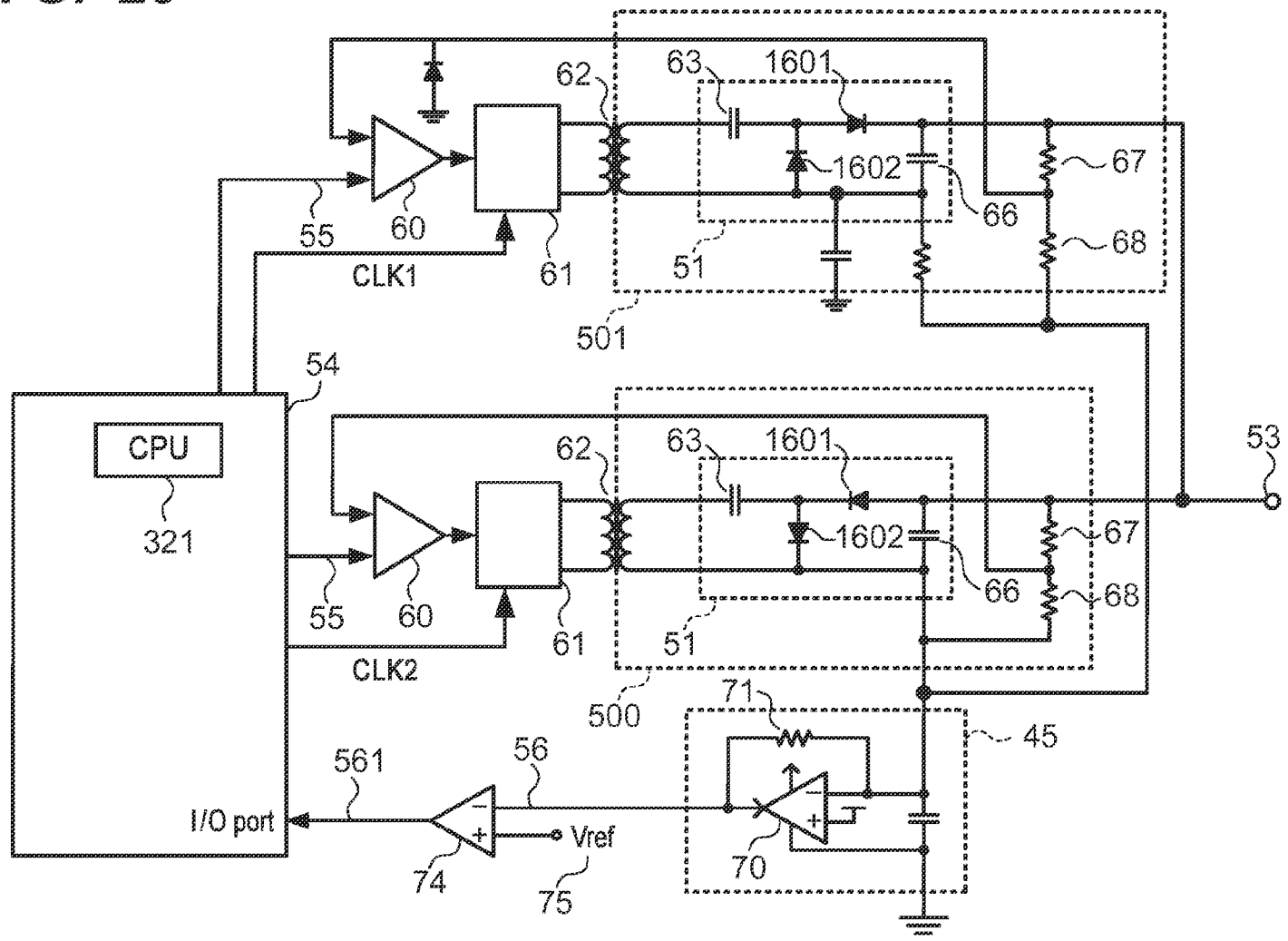
FIG. 20 is a circuit diagram showing a developing high-voltage power supply circuit according to an embodiment.

In this embodiment, a developing high-voltage power supply circuit 44 that applies a voltage to a developing sleeve 24 detects a latent image mark 80. FIG. 20 is a circuit diagram showing the arrangement of the developing high-voltage power supply circuit 44. Note that the developing high-voltage power supply circuit 44 is provided in correspondence with each color, like the charging high-voltage power supply circuit 43 of the first embodiment. The developing high-voltage power supply circuit 44 has the same arrangement as that of the charging high-voltage power supply circuit 43 shown in FIG. 3 except that an output circuit 501 of a different polarity is added, and a detailed description thereof will be omitted. Note that polarity switching is done by CLK1 and CLK2 output from a control unit 54.

In this embodiment, when detecting the latent image mark 80 formed on a photosensitive member 22, the developing sleeve 24 is placed in contact with the photosensitive member 22. In addition, a developing bias is applied to the developing sleeve 24, as in normal image formation. That is, an output circuit 500 shown in FIG. 20 is selected. When the latent image mark 80 reaches the position of the developing sleeve 24, the toner moves, and a current then flows to the developing sleeve 24. A current detection circuit 45 detects the current, thereby detecting the latent image mark 80. Note that a primary transfer roller 26 is separated from the photosensitive member 22 not to transfer the toner to an intermediate transfer belt 30.

When detecting the latent image mark 80 formed on the photosensitive member 22, the developing sleeve 24 may be placed in contact with the photosensitive member 22, and the output circuit 501 shown in FIG. 20 may be selected to apply a developing bias of an opposite polarity. Current change detection by the current detection circuit 45 in this case is the same as in the first embodiment except that the direction of the current is different. That is, the current flows due to discharge between the surface of the developing sleeve 24 and that of the photosensitive member 22 or via the nip portion between the developing sleeve 24 and the photosensitive member 22. Note that color misregistration correction control performed by detecting the edges of the latent image marks 80 is the same as in the first and second embodiments, and a description thereof will be omitted.

Even when the developing high-voltage power supply circuit 44 that applies a voltage to the developing sleeve 24 detects the latent image mark 80, as described above, the interval between the latent image marks 80 that are adjacent to each other in the rotation direction of the photosensitive member and are used when performing color misregistration correction control is set to be equal to or larger than a width L of the discharge generation region. In addition to or instead of this, the width of the latent image mark 80 is set to be equal to or larger than the width L of the discharge generation region. This allows to accurately detect the latent image marks 80. Since the latent image marks 80 can accurately be detected, the positional shift of an image can also accurately be corrected.

Note that in the first embodiment, the positional shift of each color with respect to the reference value is corrected, that is, the correction is performed independently for each color. In the second embodiment, a positional shift with respect to the reference color is corrected. However, even in the first embodiment, the arrangement for correcting a positional shift with respect to the reference color is usable. Even in the second embodiment, the arrangement for performing the correction independently for each color is usable. In the third embodiment as well, both the arrangement for performing the correction independently for each color and the arrangement for correcting the positional shift of each color with respect to the reference color are usable.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-018641, filed Jan. 31, 2012, which is hereby incorporated by reference herein in its entirety.

The invention claimed is:

1. An image forming apparatus comprising:

a photosensitive member configured to be rotated;

an irradiating unit configured to irradiate the photosensitive member that is charged with light corresponding to image data, thereby forming an electrostatic latent image on the photosensitive member; and a process unit configured to form a nip portion with the photosensitive member, wherein in a correction mode in which a shift of an image is corrected based on a detection result obtained by detecting, at the nip portion, an electrostatic latent image for correction formed on the photosensitive member by the irradiating unit, a width of the electrostatic latent image for correction is equal to or more than a width of the nip portion in a rotation direction of the photosensitive member.

2. An image forming apparatus comprising:

a photosensitive member configured to be rotated;

an irradiating unit configured to irradiate the photosensitive member that is charged with light corresponding to image data, thereby forming an electrostatic latent image on the photosensitive member; and a process unit configured to form a nip portion with the photosensitive member, wherein in a correction mode in which a shift of an image is corrected based on a detection result obtained by detecting, at the nip portion, an electrostatic latent image for correction formed on the photosensitive member by the irradiating unit, an interval between a first electrostatic latent image for correction and a second electrostatic latent image for correction formed subsequently after formation of the first electrostatic latent image for correction is equal to or more than a width of the nip portion in a rotation direction of the photosensitive member.

3. An image forming apparatus comprising:

a photosensitive member configured to be rotated;

an irradiating unit configured to irradiate the photosensitive member that is charged with light corresponding to image data, thereby forming an electrostatic latent image on the photosensitive member; and a process unit configured to form a nip portion with the photosensitive member, wherein in a correction mode in which a shift of an image is corrected based on a detection result obtained by detecting, at the nip portion, an electrostatic latent image for correction formed on the photosensitive member by the irradiating unit, a width of the electrostatic latent image for correction is equal to or more than a width of the nip portion in a rotation direction of the photosensitive member, and an interval between a first electrostatic latent image for correction and a second electrostatic latent image for correction formed subsequently after formation of the first electrostatic latent image for correction is equal to or more than the width of the nip portion in the rotation direction of the photosensitive member.

4. The apparatus according to claim 1, wherein a leading edge of the electrostatic latent image for correction corresponds to a timing at which the detection result obtained by detecting the electrostatic latent image for correction at the nip portion matches a threshold, a trailing edge of the electrostatic latent image for correction corresponds to a timing at which the detection result obtained by detecting the electrostatic latent image for correction at the nip portion matches the threshold again after detection of the leading edge, and a length from the leading edge to the trailing edge corresponds to the width of the electrostatic latent image for correction.

5. The apparatus according to claim 2, wherein a trailing edge of the first electrostatic latent image for correction corresponds to a timing at which the detection result obtained by detecting the first electrostatic latent image for correction at the nip portion matches a threshold again after detection of a leading edge of the first electrostatic latent image for correction, a leading edge of the second electrostatic latent image for correction corresponds to a timing at which the detection result obtained by detecting the second electrostatic latent image for correction at the nip portion matches the threshold after detection of the trailing edge of the first electrostatic latent image for correction, and a length from the trailing edge of the first electrostatic latent image for correction to the leading edge of the second electrostatic latent image for correction corresponds to the interval between the first electrostatic latent image for correction and the second electrostatic latent image for correction formed subsequently after formation of the first electrostatic latent image for correction.

6. The apparatus according to claim 1, wherein the process unit is one of a charging unit configured to charge the photosensitive member, a developing unit configured to develop the electrostatic latent image formed on the photosensitive member by a toner and form a toner image on the photosensitive member, and a transfer unit configured to transfer the toner image formed on the photosensitive member to one of a printing medium and an image carrier.

7. The apparatus according to claim 1, further comprising:

a voltage application unit configured to apply a voltage to the process unit; and a current detection unit configured to detect a current that flows to the voltage application unit via the process unit when the voltage application unit applies the voltage to the process unit, wherein the shift of the image is corrected based on the detection result obtained by the current detection unit by detecting presence or absence of the electrostatic latent image for correction at the nip portion.

8. The apparatus according to claim 2, wherein a width of a region where the irradiating unit does not irradiate the photosensitive member with the light to form the interval between the electrostatic latent images for correction adjacent to each other in the rotation direction of the photosensitive member is equal to or more than the width of the nip portion.

9. An image forming apparatus comprising:

a photosensitive member configured to be rotated;

an irradiating unit configured to irradiate the photosensitive member that is charged with light corresponding to image data, thereby forming an electrostatic latent image on the photosensitive member; and a process unit configured to act on the photosensitive member for image formation, wherein in a correction mode in which a shift of an image is corrected based on a detection result obtained by detecting, in a charge movement region that is a region where charges move between the photosensitive member and the process unit, an electrostatic latent image for correction formed on the photosensitive member by the irradiating unit, a width of the electrostatic latent image for correction is equal to or more than a width of the charge movement region in a rotation direction of the photosensitive member.

10. An image forming apparatus comprising:

a photosensitive member configured to be rotated;

an irradiating unit configured to irradiate the photosensitive member that is charged with light corresponding to image data, thereby forming an electrostatic latent image on the photosensitive member; and a process unit configured to act on the photosensitive member for image formation, wherein in a correction mode in which a shift of an image is corrected based on a detection result obtained by detecting, in a charge movement region that is a region where charges move between the photosensitive member and the process unit, an electrostatic latent image for correction formed on the photosensitive member by the irradiating unit, an interval between a first electrostatic latent image for correction and a second electrostatic latent image for correction formed subsequently after formation of the first electrostatic latent image for correction is equal to or more than a width of the charge movement region in a rotation direction of the photosensitive member.

11. An image forming apparatus comprising:

a photosensitive member configured to be rotated;

an irradiating unit configured to irradiate the photosensitive member that is charged with light corresponding to image data, thereby forming an electrostatic latent image on the photosensitive member; and a process unit configured to act on the photosensitive member for image formation, wherein in a correction mode in which a shift of an image is corrected based on a detection result obtained by detecting, in a charge movement region that is a region where charges move between the photosensitive member and the process unit, an electrostatic latent image for correction formed on the photosensitive member by the irradiating unit, a width of the electrostatic latent image for correction is equal to or more than a width of the charge movement region in a rotation direction of the photosensitive member, and an interval between a first electrostatic latent image for correction and a second electrostatic latent image for correction formed subsequently after formation of the first electrostatic latent image for correction is equal to or more than the width of the charge movement region.

12. The apparatus according to claim 9, wherein a leading edge of the electrostatic latent image for correction corresponds to a timing at which the detection result obtained by detecting the electrostatic latent image for correction at the charge movement region matches a threshold, a trailing edge of the electrostatic latent image for correction corresponds to a timing at which the detection result obtained by detecting the electrostatic latent image for correction at the charge movement region matches the threshold again after detection of the leading edge, and a length from the leading edge to the trailing edge corresponds to the width of the electrostatic latent image for correction.

13. The apparatus according to claim 10, wherein a trailing edge of the first electrostatic latent image for correction corresponds to a timing at which the detection result obtained by detecting the first electrostatic latent image for correction at the charge movement region matches a threshold again after detection of a leading edge of the first electrostatic latent image for correction, a leading edge of the second electrostatic latent image for correction corresponds to a timing at which the detection result obtained by detecting the second electrostatic latent image for correction at the charge movement region matches the threshold after detection of the trailing edge of the first electrostatic latent image for correction, and a length from the trailing edge of the first electrostatic latent image for correction to the leading edge of the second electrostatic latent image for correction corresponds to the interval between the first electrostatic latent image for correction and the second electrostatic latent image for correction formed subsequently after formation of the first electrostatic latent image for correction.

14. The apparatus according to claim 9, wherein letting r (mm) be a radius of the photosensitive member, R (mm) be a radius of the process unit, VL (V) be a surface potential of a portion of the photosensitive member where the electrostatic latent image is formed, and VD (V) be a surface potential of a portion of the photosensitive member where the electrostatic latent image is not formed, the width L (mm) of the charge movement region in the rotation direction is given by $$L=r\cdot(\theta-\theta')$$

$$\theta=f(D_A),\theta'=f(8)$$

$$f(D)=\cos^{-1}((n^2-m+1)/2n)$$

$$n=((R+r)\cdot 10^3-D)/(r\cdot 10^3)$$

$$m=(R/r)^2$$

$$D_A=(VL-VD+Vpa(8)-312)/6.2$$

$$Vpa(D)=312+6.2D.$$

15. The apparatus according to claim 9, wherein the charges move due to discharge in the charge movement region.

16. The apparatus according to claim 9, wherein the charges move via a contact portion between the photosensitive member and the process unit in the charge region.

* * * * *